US011952159B2

(12) United States Patent
Menta

(10) Patent No.: US 11,952,159 B2
(45) Date of Patent: Apr. 9, 2024

(54) RANDOM CASE SEALER

(71) Applicant: Signode Industrial Group LLC, Glenview, IL (US)

(72) Inventor: William J. Menta, West Wyoming, PA (US)

(73) Assignee: Signode Industrial Group LLC, Tampa, FL (US)

( * ) Notice: Subject to any disclaimer, the term of this patent is extended or adjusted under 35 U.S.C. 154(b) by 92 days.

(21) Appl. No.: 17/197,921

(22) Filed: Mar. 10, 2021

(65) Prior Publication Data

US 2021/0300611 A1 Sep. 30, 2021

Related U.S. Application Data

(60) Provisional application No. 62/994,555, filed on Mar. 25, 2020.

(51) Int. Cl.
*B65B 57/02* (2006.01)
*B65B 7/20* (2006.01)

(52) U.S. Cl.
CPC ..... *B65B 57/02* (2013.01); *B65B 7/20* (2013.01)

(58) Field of Classification Search
CPC ..... B65B 57/02; B65B 7/20
See application file for complete search history.

(56) References Cited

U.S. PATENT DOCUMENTS 1,352,899 A 9/1920 Johnson
1,779,985 A 10/1930 Schroeder
2,691,260 A 10/1954 Schlemmer
2,804,738 A 9/1957 Shenigo
3,267,640 A 8/1966 Romney et al.
3,374,604 A 3/1968 Roesner et al.
3,716,962 A 2/1973 Topler et al.
3,769,777 A 11/1973 Freakes et al.
3,775,937 A 12/1973 Devan et al.
3,892,618 A 7/1975 Griebat
3,915,786 A 10/1975 Collett et al.
3,954,550 A 5/1976 Patterson
3,959,950 A 6/1976 Fukuda
3,973,375 A 8/1976 Loveland
4,010,597 A 3/1977 Nelson
4,063,403 A 12/1977 Bergstein et al.
4,079,577 A 3/1978 Ulrich et al.
(Continued)

FOREIGN PATENT DOCUMENTS

CN 201424150 Y 3/2010
CN 201424151 Y 3/2010
(Continued)

OTHER PUBLICATIONS

"Case Sealer Uniform Legend," Little David, Case Sealing for the Real World (2 pages), 2004.
(Continued)

*Primary Examiner* — Joshua G Kotis
*Assistant Examiner* — Scott A Howell
(74) *Attorney, Agent, or Firm* — Neal, Gerber & Eisenberg LLP

(57) ABSTRACT

Various embodiments of the present disclosure provide a random case sealer configured to interrupt the case-sealing process upon detecting an object between the top-head assembly and the top surface of the case.

13 Claims, 20 Drawing Sheets

(56) References Cited

U.S. PATENT DOCUMENTS

| | | | | |
|---|---|---|---|---|
| 4,213,285 | A | 7/1980 | Mancini | |
| 4,233,798 | A | 11/1980 | Helding | |
| 4,293,086 | A | 10/1981 | Fincher et al. | |
| 4,295,771 | A | 10/1981 | Mehesan, Jr. | |
| 4,317,319 | A | 3/1982 | Price | |
| 4,422,282 | A | 12/1983 | Marchetti | |
| 4,478,023 | A | 10/1984 | Becker | |
| 4,517,784 | A | 5/1985 | Beckett | |
| 4,524,560 | A | 6/1985 | Goodman | |
| 4,538,398 | A * | 9/1985 | Marchetti | B65B 51/067 53/76 |
| 4,541,888 | A | 9/1985 | Marchetti | |
| 4,543,767 | A | 10/1985 | Wiseman | |
| 4,545,175 | A | 10/1985 | Beckett | |
| 4,562,686 | A | 1/1986 | Focke | |
| 4,565,050 | A | 1/1986 | Norris | |
| 4,585,504 | A | 4/1986 | Marchetti | |
| 4,642,966 | A | 2/1987 | Marchetti | |
| 4,722,165 | A | 2/1988 | Marchetti | |
| 4,778,554 | A | 10/1988 | Doman | |
| 4,781,786 | A * | 11/1988 | Lerner | B65B 51/067 156/468 |
| 4,955,177 | A | 9/1990 | Lerner et al. | |
| 4,972,654 | A | 11/1990 | Marchetti | |
| 4,984,409 | A | 1/1991 | Focke | |
| 5,022,214 | A | 6/1991 | Kim | |
| 5,063,726 | A | 11/1991 | Boisseau | |
| 5,066,346 | A | 11/1991 | Long et al. | |
| 5,102,382 | A | 4/1992 | Center et al. | |
| 5,173,140 | A | 12/1992 | Vasilakes | |
| 5,255,490 | A | 10/1993 | Chiu | |
| 5,323,586 | A | 6/1994 | Lissoni et al. | |
| 5,341,626 | A | 8/1994 | Beckmann | |
| 5,454,776 | A | 10/1995 | Ulrich et al. | |
| 5,685,814 | A | 11/1997 | Le | |
| 6,067,773 | A | 5/2000 | Le | |
| 6,070,396 | A | 6/2000 | Rinaldi et al. | |
| 6,318,049 | B1 | 11/2001 | Raudat et al. | |
| 6,319,183 | B1 | 11/2001 | Ballos | |
| 6,669,616 | B1 | 12/2003 | Bierenacki et al. | |
| 6,725,629 | B2 | 4/2004 | Pearce et al. | |
| 6,910,314 | B2 | 6/2005 | Le | |
| 7,140,165 | B2 | 11/2006 | Ventura et al. | |
| 7,269,933 | B2 | 9/2007 | Le | |
| 7,278,248 | B2 | 10/2007 | Vinh | |
| 7,331,916 | B2 | 2/2008 | Fox | |
| 7,886,503 | B2 | 2/2011 | Chase et al. | |
| 8,079,395 | B2 | 12/2011 | Fox et al. | |
| 8,109,062 | B2 | 2/2012 | Chase et al. | |
| 8,499,532 | B2 | 8/2013 | Park et al. | |
| 9,452,852 | B2 | 9/2016 | Sambuca | |
| 9,630,796 | B2 | 4/2017 | Menta et al. | |
| 2002/0170271 | A1 | 11/2002 | Pearce et al. | |
| 2003/0101688 | A1 * | 6/2003 | Albarran | B65B 59/003 53/378.3 |
| 2004/0068956 | A1 | 4/2004 | Hartness et al. | |
| 2004/0093829 | A1 | 5/2004 | Marchetti | |
| 2004/0226268 | A1 | 11/2004 | Vinh | |
| 2005/0235603 | A1 | 10/2005 | Le | |
| 2007/0079892 | A1 | 4/2007 | Cohen et al. | |
| 2009/0064636 | A1 * | 3/2009 | Chu | B65B 59/02 156/468 |
| 2009/0217535 | A1 | 9/2009 | Fox et al. | |
| 2009/0218047 | A1 | 9/2009 | Fox et al. | |
| 2009/0218048 | A1 | 9/2009 | Fox et al. | |
| 2011/0041464 | A1 * | 2/2011 | Park | B65B 59/003 53/476 |
| 2012/0102893 | A1 * | 5/2012 | Sambuca, Jr. | B65B 59/005 53/476 |
| 2012/0232699 | A1 * | 9/2012 | Menta | B65H 35/0013 83/648 |
| 2013/0174962 | A1 * | 7/2013 | Fasse | B65H 37/04 156/324 |
| 2015/0210418 | A1 | 7/2015 | Cheich et al. | |
| 2019/0283914 | A1 | 9/2019 | Menta et al. | |
| 2021/0009294 | A1 * | 1/2021 | Menta | B65B 67/02 |
| 2021/0300611 | A1 * | 9/2021 | Menta | B65B 51/067 |
| 2022/0089308 | A1 | 3/2022 | Monti | |

FOREIGN PATENT DOCUMENTS

| | | | |
|---|---|---|---|
| CN | 101804924 | A | 8/2010 |
| EP | 3053864 | A1 | 8/2016 |

OTHER PUBLICATIONS

LDXRTB 2.0 Series Random Top and Bottom Drive Fully Automatic Case Sealer Operator's Manual, Loveshaw, an ITW Company, Little David Case Sealer (100 pages),Feb. 18, 2013.

"Little David Owners Manual LD16R," The Loveshaw Corporation (59 pages).

"Extended European Search Report", from corresponding European Patent Application No. 21163426.6 (7 pages), dated Aug. 30, 2021.

"Office Action and Examination Search Report", from corresponding Canadian Patent Application No. 3111986, dated Jul. 5, 2022.

"Office Action and Examination Search Report", from corresponding Canadian Patent Application No. 3,111,986, dated Feb. 20, 2023.

* cited by examiner

RANDOM CASE SEALER

PRIORITY

This application claims priority to and the benefit of U.S. Provisional Patent Application No. 62/994,555, filed Mar. 25, 2020, the entire contents of which is incorporated herein by reference.

FIELD

The present disclosure relates to case sealers, and more particularly to random case sealers configured to seal cases of different heights.

BACKGROUND

Every day, companies around the world pack millions of items in cases (such as boxes formed from corrugated) to prepare them for shipping. Case sealers partially automate this process by applying pressure-sensitive tape to cases already packed with items and (in certain instances) protective dunnage to seal those cases shut. Random case sealers (a subset of case sealers) automatically adjust to the height of the case to-be-sealed so they can seal cases of different heights.

A typical random case sealer includes a top-head assembly with a pressure switch at its front end. The top-head assembly moves vertically under control of two pneumatic cylinders to accommodate cases of different heights. The top-head assembly includes a tape cartridge configured to apply tape to the top surface of the case as it moves past the tape cartridge. One known tape cartridge includes a front roller assembly, a cutter assembly, a rear roller assembly, a tape-mounting assembly, and a tension-roller assembly. A roll of tape is mounted to the tape-mounting assembly. A free end of the tape is routed through several rollers of the tension-roller assembly until the free end of the tape is adjacent a front roller of the front roller assembly with its adhesive side facing outward (toward the incoming cases).

In operation, an operator moves a case into contact with the pressure switch. In response, pressurized gas is introduced from a gas source into the two pneumatic cylinders to pressurize the volumes below their respective pistons to a first pressure to begin raising the top-head assembly. Once the top-head assembly ascends above the case so the case stops contacting the pressure switch, the operator moves the case beneath the top-head assembly, and the gas pressure in the pneumatic cylinders is reduced to a second, lower pressure. When pressurized at the second pressure, the pneumatic cylinders partially counter-balance the weight of the top-head assembly so the top-head assembly gently descends onto the top surface of the case.

A drive assembly of the case sealer moves the case relative to the tape cartridge. This movement causes the front roller of the front roller assembly to contact a leading surface of the case and apply the tape to the leading surface. Continued movement of the case relative to the tape cartridge forces the front roller assembly to retract against the force of a spring. This also causes the rear roller assembly to retract since the roller arm assemblies are linked. As the drive assembly continues to move the case relative to the tape cartridge, the spring forces the front roller to ride along the top surface of the case while applying the tape to the top surface. The spring also forces a rear roller of the rear roller assembly to ride along the top surface of the case (once the case reaches it).

As the drive assembly continues to move the case relative to the tape cartridge, the case contacts the cutter assembly and causes it to retract against the force of another spring, which leads to the cutter assembly riding along the top surface of the case. Once the drive assembly moves the case relative to the tape cartridge so the case's trailing surface passes the cutter assembly, the spring biases the cutter assembly back to its original position. Specifically, the spring biases an arm with a toothed blade downward to contact the tape and sever the tape from the roll, forming a free trailing end of the tape. At this point, the rear roller continues to ride along the top surface of the case, thereby maintaining the front and rear roller arm assemblies in their retracted positions.

Once the drive assembly moves the case relative to the tape cartridge so the case's trailing surface passes the rear roller, the spring forces the front and rear roller assemblies to return to their original positions. As the rear roller assembly does so, it contacts the trailing end of the severed tape and applies it to the trailing surface of the case to complete the sealing process.

Occasionally, material may protrude from the top surface of the case (such as between the closed flaps of the top surface of the case) or otherwise be present on the top surface of the case as the operator moves the case beneath the top-head assembly. This material can interfere with the sealing process and, since this known case sealer cannot detect this undesired material, it could prevent the case sealer from completely sealing the case. This material could also damage the case sealer or the case itself.

SUMMARY

Various embodiments of the present disclosure provide a random case sealer configured to interrupt the case-sealing process upon detecting an object between the top-head assembly and the top surface of the case.

One embodiment of the case sealer of the present disclosure comprises a base assembly, a top-head assembly supported by the base assembly, an actuator operably connected to the top-head assembly to move the top-head assembly relative to the base assembly, a first sensor configured to transmit an object-detected signal responsive to detecting an object and an object-undetected signal responsive to no longer detecting the object, a second sensor configured to transmit an object-detected signal responsive to detecting an object, and a controller communicatively connected to the first and second sensors and operably connected to the actuator. The controller is configured to: responsive to receiving a first object-detected signal from the first sensor, control the actuator to begin raising the top-head assembly; after receiving the first object-detected signal from the first sensor, responsive to receiving a first object-detected signal from the second sensor, begin monitoring for a second object-detected signal from the first sensor; and responsive to receiving the second object-detected signal from the first sensor, control the actuator to begin raising the top-head assembly.

DETAILED DESCRIPTION

Figure 1:
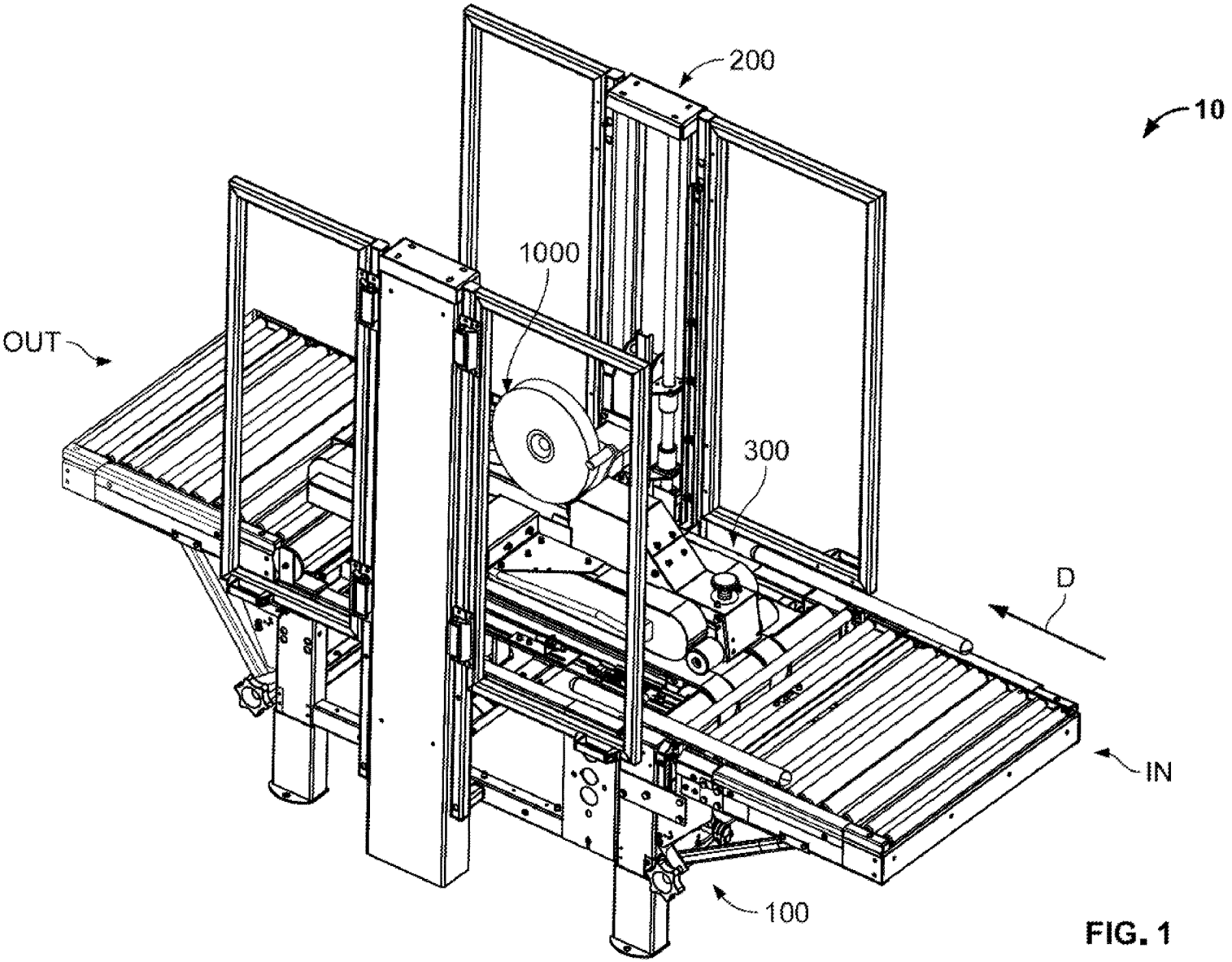
FIG. 1 is a perspective view of one example embodiment of a case sealer of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connection of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, etc., are not intended to be limited to direct mounting methods, but should be interpreted broadly to include indirect and operably coupled, mounted, connected, and like mounting methods. This specification is intended to be taken as a whole and interpreted in accordance with the principles of the present disclosure and as understood by one of ordinary skill in the art.

Various embodiments of the present disclosure provide a random case sealer configured to interrupt the case-sealing process upon detecting an object between the top-head assembly and the top surface of the case. This prevents this object from damaging the case sealer or the case and prevents suboptimal sealing.

Figure 2:
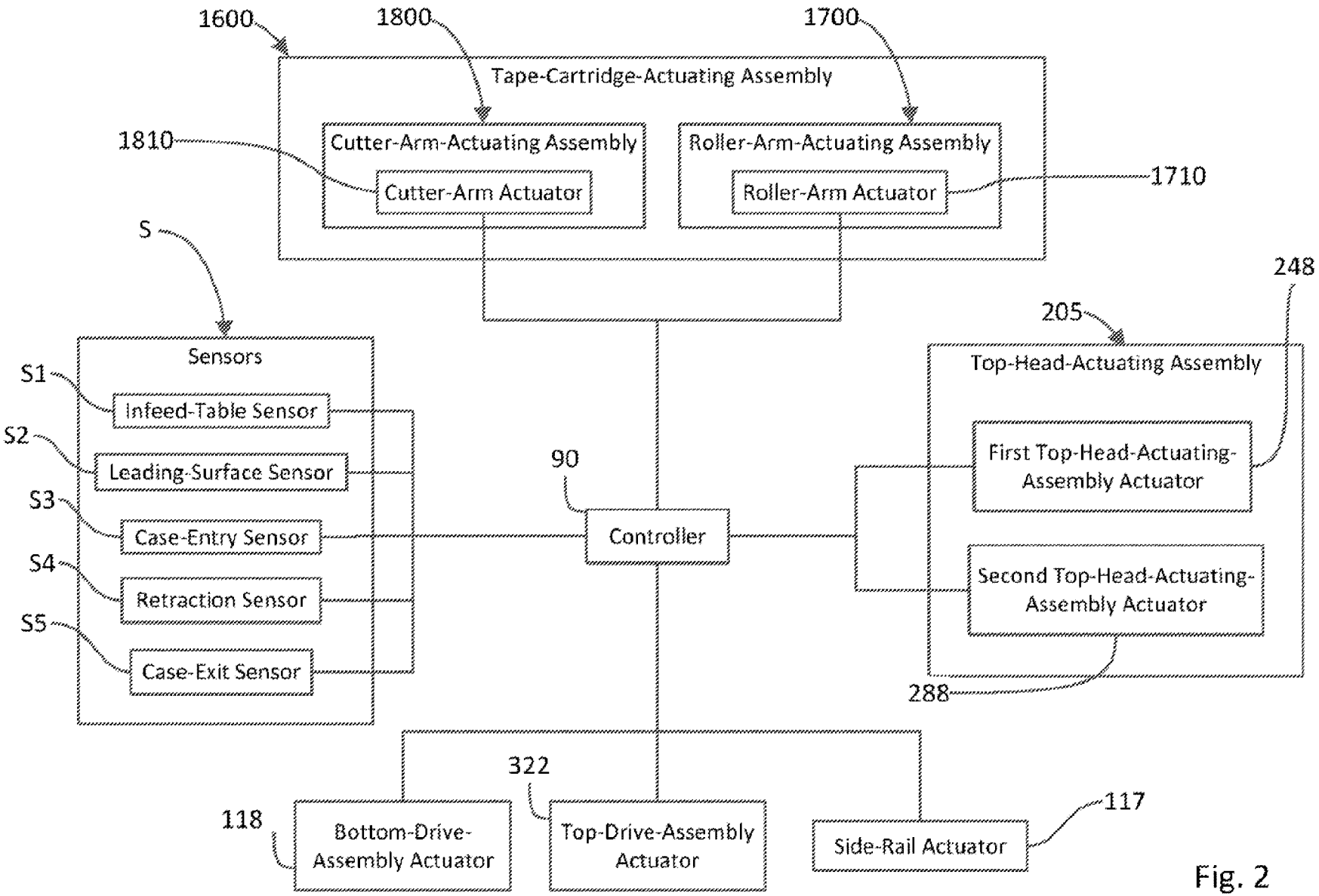
FIG. 2 is a block diagram showing certain components of the case sealer of FIG. 1.

FIG. 1 shows one example embodiment of a case sealer 10 of the present disclosure. The case sealer 10 includes a base assembly 100, a mast assembly 200, a top-head assembly 300, an upper tape cartridge 1000, and a lower tape cartridge (not shown for clarity). As shown in FIG. 2, the case sealer 10 also includes several actuating assemblies and actuators configured to control movement of certain components of the case sealer 10; multiple sensors S; and control circuitry and systems for controlling the actuating assemblies and the actuators (and other mechanical, electromechanical, and electrical components of the case sealer 10) responsive to signals received from the sensors S.

The case sealer 10 includes a controller 90 communicatively connected to the sensors S to send and receive signals to and from the sensors S. The controller 90 is operably connected to the actuating assemblies and the actuators to control the actuating assemblies and the actuators. The controller 90 may be any suitable type of controller (such as a programmable logic controller) that includes any suitable processing device(s) (such as a microprocessor, a microcontroller-based platform, an integrated circuit, or an application-specific integrated circuit) and any suitable memory device(s) (such as random access memory, read-only memory, or flash memory). The memory device(s) stores instructions executable by the processing device(s) to control operation of the case sealer 10.

Figure 3:
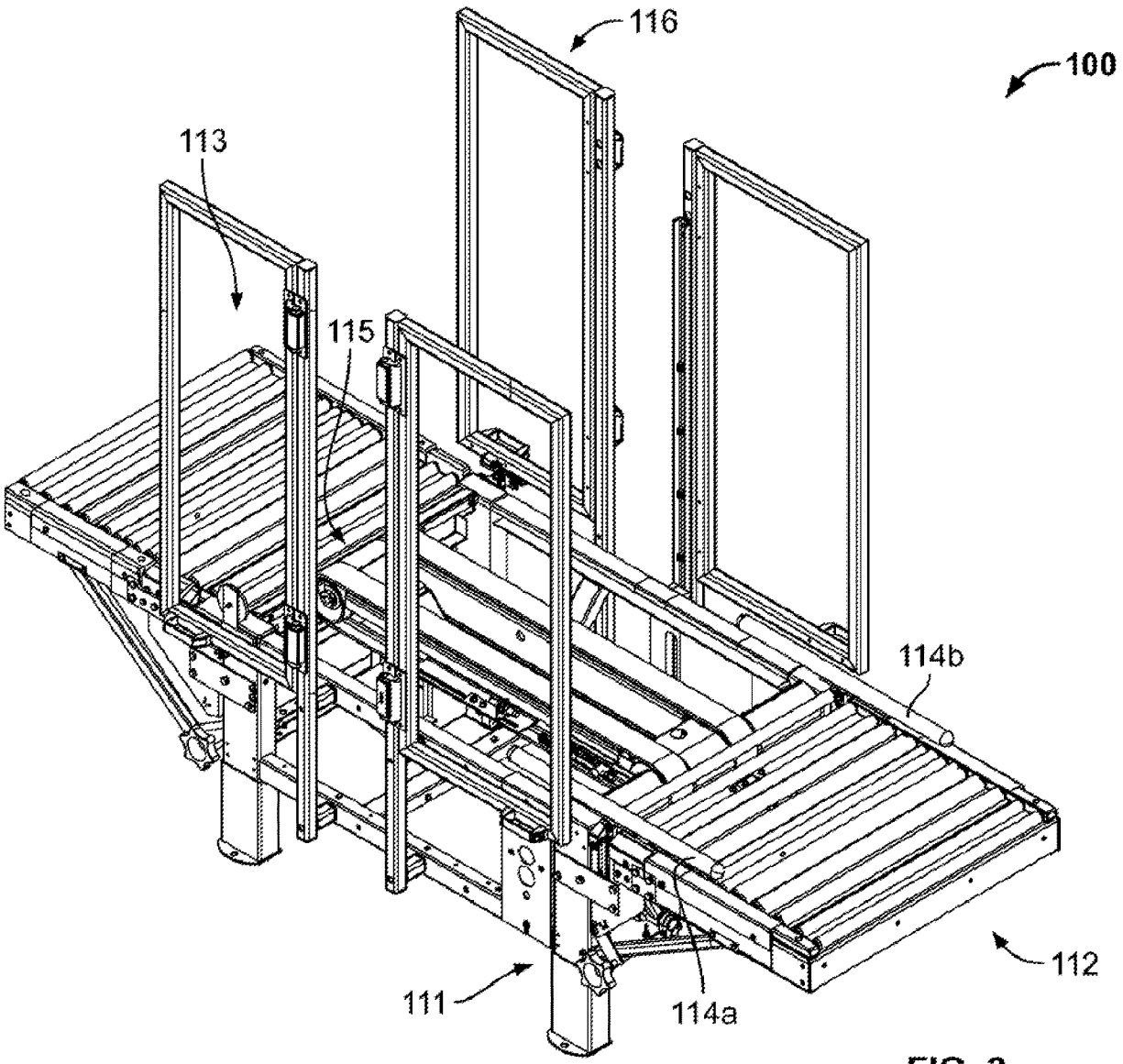
FIG. 3 is a perspective view of the base assembly of the case sealer of FIG. 1.

The base assembly 100 is configured to align cases in preparation for sealing and to move the cases through the case sealer 10 while supporting the mast assembly 200 (which supports the top-head assembly 300). As best shown in FIG. 3, the base assembly 100 includes a base-assembly frame 111, an infeed table 112, an outfeed table 113, a side-rail assembly 114 (not shown but numbered for clarity), a bottom-drive assembly 115, and a barrier assembly 116. The base assembly 100 defines an infeed end IN (FIG. 1) of the case sealer 10 at which an operator (or an automated feed system) feeds cases to-be-sealed into the case sealer 10 (via the infeed table 112) and an outfeed end OUT (FIG. 1) of the case sealer 10 at which the case sealer 10 ejects sealed cases onto the outfeed table 113.

The base-assembly frame 111 is formed from any suitable combination of solid and/or tubular members and/or plates fastened together. The base-assembly frame 111 is configured to support the other components of the base assembly 100.

The infeed table 112 is mounted to the base-assembly frame 111 adjacent the infeed end IN of the case sealer 10. The infeed table 112 includes multiple rollers on which the operator can place and fill a case and then use to convey the filled case to the top-head assembly 300. The infeed table 112 includes an infeed-table sensor S1 (FIG. 2), which may be any suitable sensor (such as a photoelectric sensor) configured to detect the presence of a case on the infeed table 112 (and, more particularly, the presence of a case at a particular location on the infeed table 112 that corresponds to the location of the infeed-table sensor S1). In other embodiments, another component of the case sealer 10 includes the infeed-table sensor S1. The infeed-table sensor S1 is communicatively connected to the controller 90 to send signals to the controller 90 responsive to detecting a case (an object-detected signal) and, afterwards, no longer detecting the case (an object-undetected signal), as described below.

The outfeed table 113 is mounted to the base-assembly frame 111 adjacent the outfeed end OUT of the case sealer 10. The outfeed table 113 includes multiple rollers onto which the case is ejected after taping.

The side-rail assembly 114 is supported by the base-assembly frame 111 adjacent the infeed table 112 and includes first and second side rails 114*a* and 114*b* and a side-rail actuator 117 (FIG. 2). The side rails 114*a* and 114*b* extend generally parallel to a direction of travel D (FIG. 1) of a case through the case sealer 10 and are movable laterally inward (relative to the direction of travel D) to laterally center the case on the infeed table 112. The side-rail actuator 117 is operably connected to the first and second side rails 114*a* and 114*b* (either directly or via suitable linkages) to move the side rails between: (1) a rest configuration (FIG. 1) in which the side rails are positioned at or near the lateral extents of the infeed table 112 to enable an operator to position a case to-be-sealed between the side rails on the infeed table 112; and (2) a centering configuration (FIG. 8A) in which the side rails (after being moved toward one another) contact the case and center the case on the infeed table 112. The controller 90 is operably connected to the side-rail actuator 117 to control the side-rail actuator 117 to move the side rails 114*a* and 114*b* between the rest and centering configurations.

The side-rail actuator 117 may be any suitable type of actuator, such as a motor or a pneumatic cylinder fed with pressurized gas and controlled by one or more valves.

The bottom-drive assembly 115 is supported by the base-assembly frame 111 and (along with a top-drive assembly 320, described below) configured to move cases in the direction D. The bottom-drive assembly 115 includes a bottom drive element and a bottom-drive-assembly actuator 118 (FIG. 2) operably connected to the bottom drive element to drive the bottom drive element to (along with the top-drive assembly 320) move cases through the case sealer 10. In this example embodiment, the bottom-drive-assembly actuator 118 includes a motor that is operably connected to the bottom drive element—which includes an endless belt in this example embodiment—via one or more other components, such as sprockets, gearing, screws, tensioning elements, and/or a chain. The bottom-drive-assembly actuator 118 may include any other suitable actuator in other embodiments. The bottom-drive element may include any other suitable component or components, such as rollers, in other embodiments. The controller 90 is operably connected to the bottom-drive-assembly actuator 118 to control operation of the bottom-drive-assembly actuator 118.

The bottom-drive assembly 115 supports a case-entry sensor S3 downstream of the infeed table 112 and the leading-surface sensor S2 (described below) and beneath the top-head assembly 300 so the case-entry sensor S3 can detect when a case enters the space below the top-head assembly 300. As used herein, "downstream" means in the direction of travel D, and "upstream" means the direction opposite the direction of travel D. The case-entry sensor S3 includes a proximity sensor (or any other suitable sensor, such as a mechanical sensor) configured to detect the presence of a case. In other embodiments, the case-entry sensor S3 is supported by the mast assembly 200 or the top-head assembly 300. The case-entry sensor S3 is communicatively connected to the controller 90 to send signals to the controller 90 responsive to detecting the case (an object-detected signal) and no longer detecting the case (an object-undetected signal).

The barrier assembly 116 includes four individually framed barriers (not labeled) that are formed from clear material, such as plastic or glass. The barriers are connected to the base-assembly frame 111 so one pair of barriers flanks the first top-head-mounting assembly 210 (described below) and the other pair of barriers flanks the second top-head-mounting assembly 250 (described below). When connected to the base-assembly frame 111, the barriers are laterally offset from the top-head assembly 300 to prevent undesired objects from entering the area surrounding the top-head assembly 300 from the sides.

The mast assembly 200 is configured to support and control vertical movement of the top-head assembly 300 relative to the base assembly 100. As best shown in FIGS. 2 and 4A-4C, the mast assembly 200 includes (in this example embodiment) identical first and second top-head-mounting assemblies 210 and 250 to which the top head 300 is attached and a top-head-actuating assembly 205 configured to control vertical movement of the top head 300.

The first top-head-mounting assembly 210 is connected to one side of the base-assembly frame 111 via mounting plates and fasteners (not labeled) or in any other suitable manner. Similarly, the second top-head-mounting assembly 250 is connected to the opposite side of the base-assembly frame 111 via mounting plates and fasteners (not labeled) or in any other suitable manner. In this example embodiment, the first and second top-head-mounting assemblies 210 and 250 are fixedly connected to the base assembly 100.

Figure 4A:
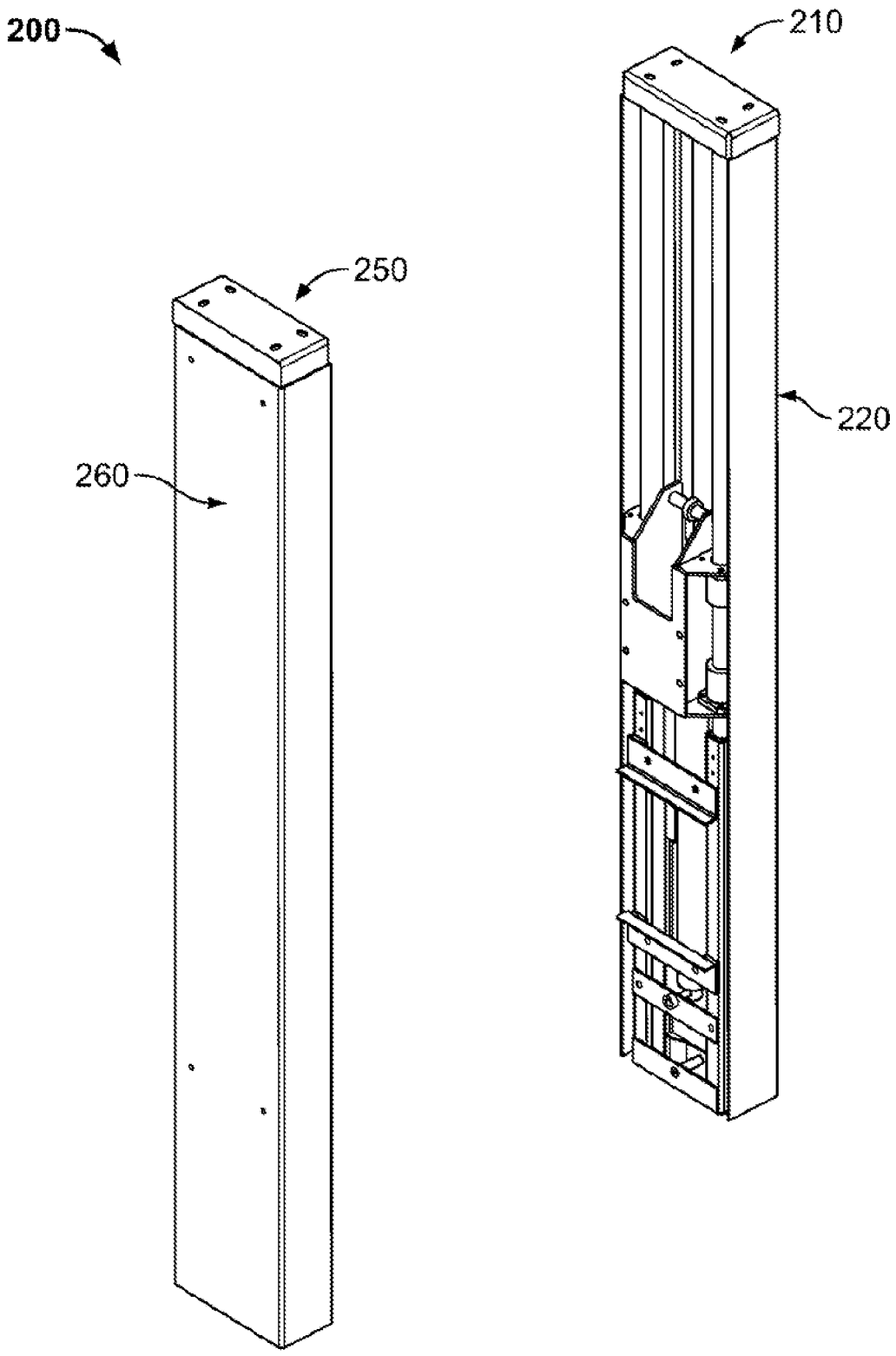
FIG. 4A is a perspective view of the mast assembly of the case sealer of FIG. 1.
Figure 4B:
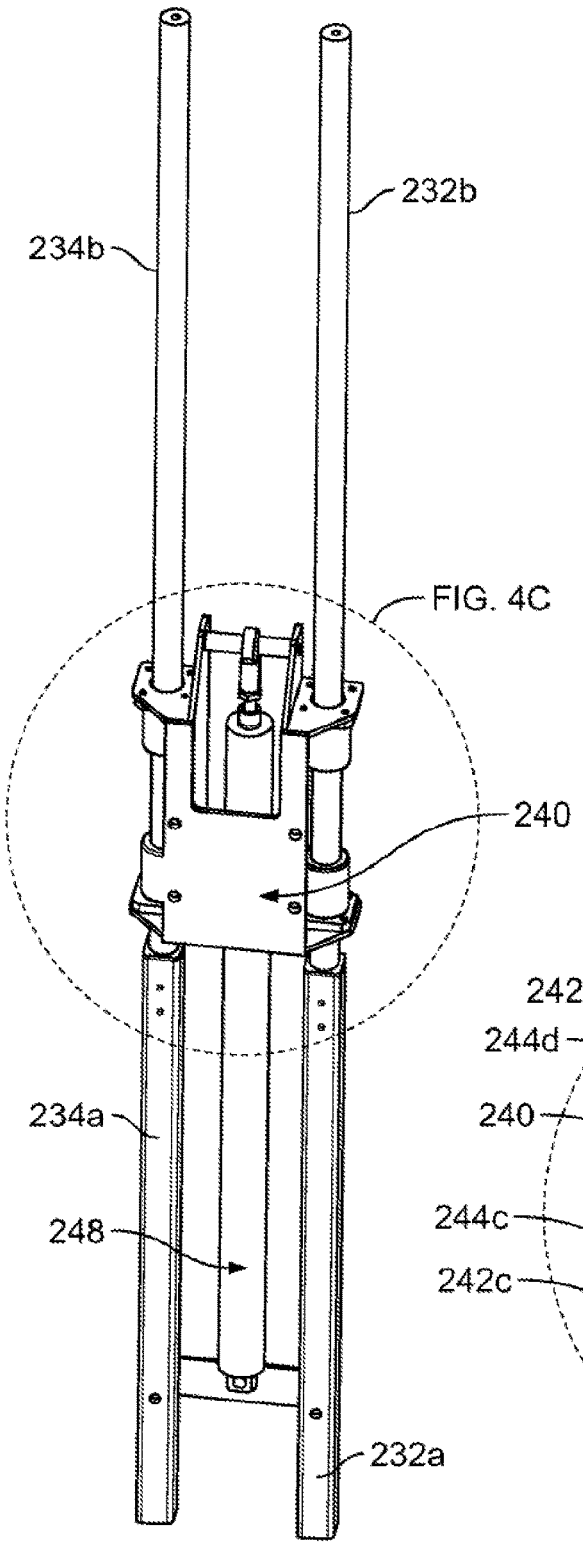
FIG. 4B is a perspective view of the part of the top-head-actuating-assembly of the mast assembly of FIG. 4A.
Figure 4C:
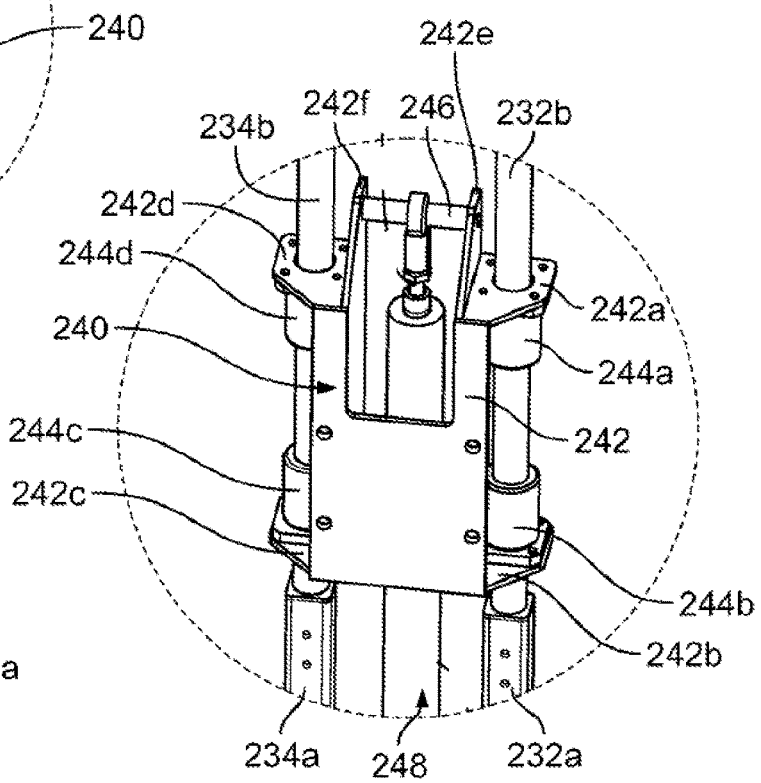
FIG. 4C is a fragmentary perspective view of the top-head-actuating assembly of FIG. 4B.

The first top-head-mounting assembly 210 includes an enclosure 220 that is connected to (via suitable fasteners or in any other suitable manner) and partially encloses part of the top-head-actuating assembly 205. As best shown in FIGS. 2, 4B, and 4C, the top-head-actuating assembly 205 includes first and second rail mounts 232*a* and 234*a*, first and second rails 232*b* and 234*b*, a first carriage 240, and a first top-head-actuating-assembly actuator 248. In this example embodiment, the first top-head-actuating-assembly actuator 248 includes a pneumatic cylinder fed with pressurized gas and controlled by one or more valves, though it may be any other suitable type of actuator (such as a motor) in other embodiments.

The first and second rail mounts 232*a* and 234*a* include elongated tubular members having a rectangular cross-section, and the first and second rails 232*b* and 234*b* are elongated solid (or in certain embodiments, tubular) members having a circular cross-section. The first rail 232*b* is mounted to the first rail mount 232*a* so the first rail 232*b* and the first rail mount 232*a* share the same longitudinal axis. The second rail 234*b* is mounted to the second rail mount 234*a* so the second rail 234*b* and the second rail mount 234*a* share the same longitudinal axis.

The first carriage 240 includes a body 242 that includes a first pair of outwardly extending spaced-apart mounting wings 242*a* and 242*b*, a second pair of outwardly extending spaced-apart mounting wings 242*c* and 242*d*, a pair of upwardly extending mounting ears 242*e* and 242*f*, four linear bearings 244*a*-244*d*, and a shaft 246. Each mounting wing 242*a*-242*f* defines a mounting opening therethrough (not labeled). Each linear bearing 244*a*-244*d* defines a mounting bore therethrough (not labeled). The linear bearings 244*a*-244*d* are connected to the mounting wings 242*a*-242*d*, respectively, so the mounting openings of the mounting wings and the mounting bores of the linear bearings are aligned. The shaft 246 is received in the mounting openings of the mounting ears 242*e* and 242*f* so the shaft 246 extends between those mounting ears.

The first carriage 240 is slidably mounted to the first and second rails 232*b* and 234*b* via: (1) receiving the first rail 232*b* through the mounting openings in the mounting wings 242*a* and 242*b* and the mounting bores in the linear bearings 244*a* and 244*b*; and (2) receiving the second rail 234*a* through the mounting openings in the mounting wings 242*c* and 242*d* and the mounting bores in the linear bearings 244*c* and 244*d*. The first top-head-actuating-assembly actuator 248 is operably connected to the first carriage 240 to move the carriage along and relative to the rails 232*b* and 234*b*. Specifically, the first top-head-actuating-assembly actuator 248 is connected to a plate (not labeled) that extends between the first and second rail supports 232*a* and 234*a* and to the shaft 246. This enables the first top-head-actuating-assembly actuator 248 to control movement of the first carriage 240 along the rails 232*b* and 234*b*.

The second top-head-mounting assembly 250 includes an enclosure 260 that is connected to (via suitable fasteners or in any other suitable manner) and partially encloses another part of the top-head-actuating assembly 205 (FIG. 2). Although not separately shown for brevity (since these parts are identical to those described above that the first top-head-mounting assembly 210 encloses), these components of the top-head-actuating assembly 205 are numbered below for clarity and ease of reference. The top-head-actuating assembly 205 includes third and fourth rail mounts 272*a* and 274*a*, third and fourth rails 272*b* and 274*b*, a second carriage 280, and a second top-head-actuating-assembly actuator 288 in the form of a second top-head-actuating-assembly actuator 288. In this example embodiment, the second top-head-actuating-assembly actuator 288 includes a pneumatic cylinder fed with pressurized gas and controlled by one or more valves, though it may be any other suitable type of actuator (such as a motor) in other embodiments.

The third and fourth rail mounts 272*a* and 274*a* include elongated tubular members having a rectangular cross-section, and the third and fourth rails 272*b* and 274*b* are elongated solid (or in certain embodiments, tubular) members having a circular cross-section. The third rail 272*b* is mounted to the third rail mount 272*a* so the third rail 272*b* and the third rail mount 272*a* share the same longitudinal axis. The fourth rail 274*b* is mounted to the fourth rail mount 274*a* so the fourth rail 274*b* and the fourth rail mount 274*a* share the same longitudinal axis.

The second carriage 280 includes a body 282 that includes a first pair of outwardly extending mounting wings 282*a* and 282*b*, a second pair of outwardly extending mounting wings 282*c* and 282*d*, a pair of upwardly extending mounting ears 282*e* and 282*f*, four linear bearings 284*a*-284*d*, and a shaft 286. Each mounting wing 282*a*-282*f* defines a mounting opening therethrough (not labeled). Each linear bearing 284*a*-284*d* defines a mounting bore therethrough (not labeled). The linear bearings 284*a*-284*d* are connected to the mounting wings 282*a*-282*d*, respectively, so the mounting openings of the mounting wings and the mounting bores of the linear bearings are aligned. The shaft 286 is received in the mounting openings of the mounting ears 282*e* and 282*f* so the shaft 286 extends between those mounting ears.

The second carriage 280 is slidably mounted to the third and fourth rails 272*b* and 274*b* via: (1) receiving the third rail 272*b* through the mounting openings in the mounting wings 282*a* and 282*b* and the mounting bores in the linear bearings 284*a* and 284*b*; and (2) receiving the fourth rail 274*a* through the mounting openings in the mounting wings 282*c* and 282*d* and the mounting bores in the linear bearings 284*c* and 284*d*. The second top-head-actuating-assembly actuator 288 is operably connected to the second carriage 280 to move the carriage along and relative to the rails 272*b* and 274*b*. Specifically, the second top-head-actuating-assembly actuator 288 is connected to a plate (not labeled) that extends between the third and fourth rail supports 272*a* and 274*a* and to the shaft 286. This enables the second top-head-actuating-assembly actuator 288 to control movement of the second carriage 280 along the rails 272*b* and 274*b*.

The controller 90 is operably connected to the first and second top-head-actuating-assembly actuators 248 and 288 to control vertical movement of the top-head assembly 300.

In other embodiments, the case sealer includes a single actuator configured to control the vertical movement of the top-head assembly.

Figure 5:
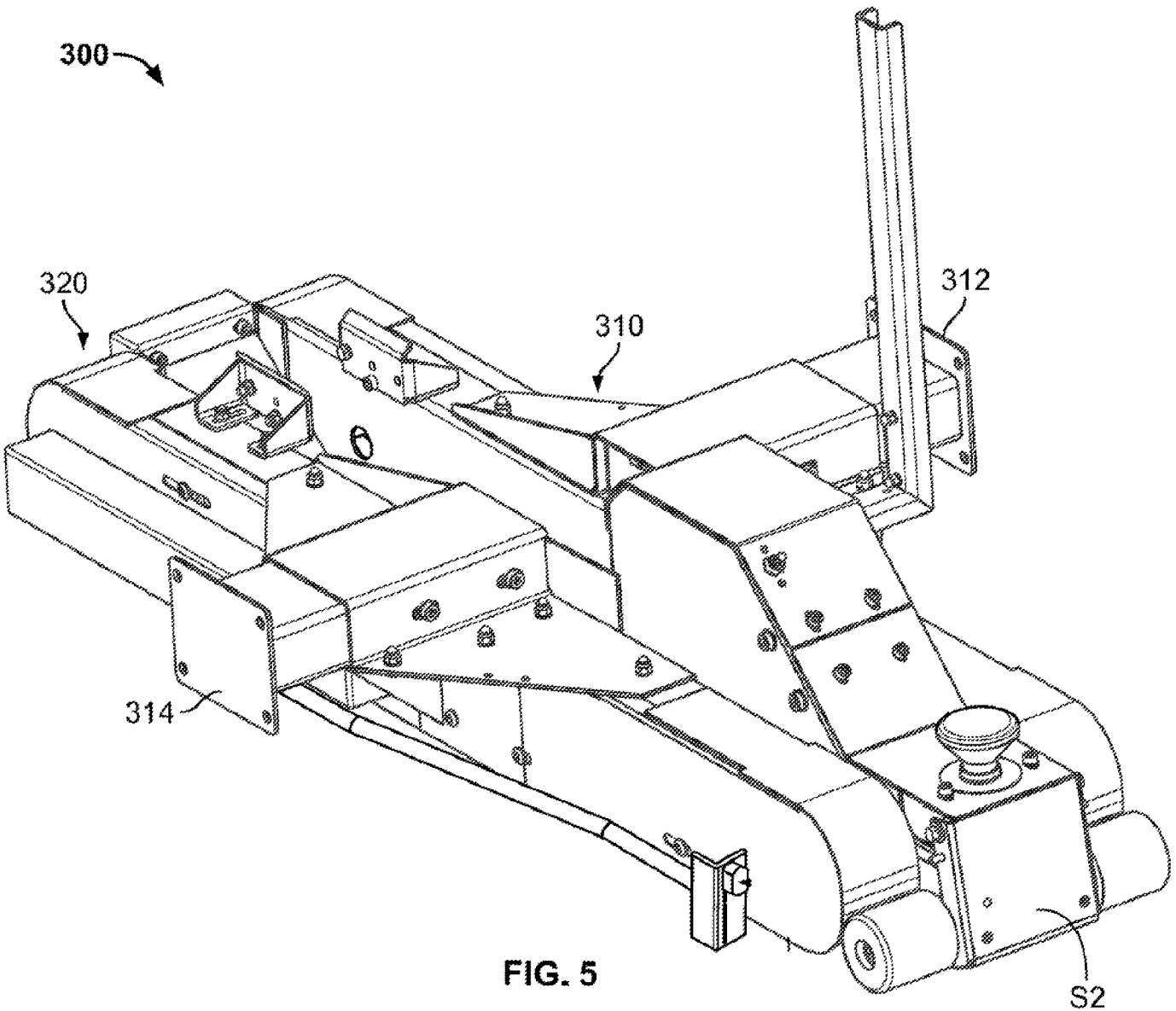
FIG. 5 is a perspective view of the top-head assembly of the case sealer of FIG. 1.

The top-head assembly 300 is movably supported by the mast assembly 200 to adjust to cases of different heights and is configured to move the cases through the case sealer 10, engage the top surfaces of the cases while doing so, and support the tape cartridge 1000. As best shown in FIGS. 2 and 5, the top-head assembly 300 includes a top-head-assembly frame 310, a top-drive assembly 320, a leading-surface sensor S2, a retraction sensor S4, and a case-exit sensor S5. In other embodiments, one or more other components of the case sealer 10 (such as the base assembly 100 and/or the mast assembly 200) include the one or more of the sensors S2, S4, and S5.

The top-head-assembly frame 310 is configured to mount the top-head assembly 300 to the mast assembly 200 and to support the other components of the top-head assembly 300, and is formed from any suitable combination of solid or tubular members and/or plates fastened together. The top-head-assembly frame 310 includes laterally extending first and second mounting arms 312 and 314 that are connected to the carriages 240 and 280, respectively, of the first and second top-head-mounting assemblies 210 and 250 via suitable fasteners.

The top-drive assembly 320 is supported by the top-head-assembly frame 310 and (along with the bottom-drive assembly 115, described above) configured to move cases in the direction D. The top-drive assembly 320 includes a top-drive element and a top-drive-assembly actuator 322 (FIG. 2) operably connected to the top-drive element to drive the top-drive element to (along with the bottom-drive assembly 115) move cases through the case sealer 10. In this example embodiment, the top-drive-assembly actuator 322 includes a motor that is operably connected to the top-drive element—which includes an endless belt in this example embodiment—via one or more other components, such as sprockets, gearing, screws, tensioning elements, and/or a chain. The top-drive-assembly actuator 322 may include any other suitable actuator in other embodiments. The top-drive element may include any other suitable component or components, such as rollers, in other embodiments. The controller 90 is operably connected to the top-drive-assembly actuator 322 to control operation of the top-drive-assembly actuator 322.

The leading-surface sensor S2 includes a mechanical paddle switch (or any other suitable sensor, such as a proximity sensor) positioned at a front end of the top-head-assembly frame 310 and configured to detect: (1) when the leading surface of a case initially contacts (or is within a predetermined distance of) the top-head assembly 300; and (2) when an object is positioned between the top-head assembly 300 and the top surface of the case. The leading-surface sensor S2 is communicatively connected to the controller 90 to send signals to the controller 90 responsive to actuation (an object-detected signal) and de-actuation (an object-undetected signal) of the leading-surface sensor S2 (corresponding to the leading-surface sensor S2 detecting and no longer detecting the case and/or an object).

The retraction sensor S4 includes a proximity sensor (or any other suitable sensor) configured to detect the presence of a case. Here, although not shown, the retraction sensor S4 is positioned on the underside of the top-head-assembly frame 310 downstream of the case-entry sensor S3 so the retraction sensor S4 can detect when a case reaches a particular position underneath the top-head assembly 300 (here, a position just before the case contacts the front roller, as explained below). The retraction sensor S4 is communicatively connected to the controller 90 to send signals to the controller 90 responsive to detecting the case (an object-detected signal) and no longer detecting the case (an object-undetected signal).

The case-exit sensor S5 includes a proximity sensor (or any other suitable sensor) configured to detect the presence of a case. Here, although not shown, the case-exit sensor S5 is positioned on the underside of the top-head-assembly frame 310 near the rear end of the top-head-assembly frame 310 (downstream of the case-entry and retraction sensors S3 and S4) so the case-exit sensor S5 can detect when a case exits from beneath the top-head assembly 300. The case-exit sensor S5 is communicatively connected to the controller 90 to send signals to the controller 90 responsive to detecting the case (an object-detected signal) and no longer detecting the case (an object-undetected signal).

The controller 90 is operably connected to: (1) the top-head-actuating assembly 205 and configured to control the top-head-actuating assembly 205 to control vertical movement of the top-head assembly 300 responsive to signals received from the sensors S2, S3, and S5; and (2) the upper tape cartridge 1000 and the lower tape cartridge and configured to control the force-reduction functionality of these tape cartridges responsive to signals received from the sensor S4, as described in detail below in conjunction with FIGS. 7-8F.

Figure 6A:
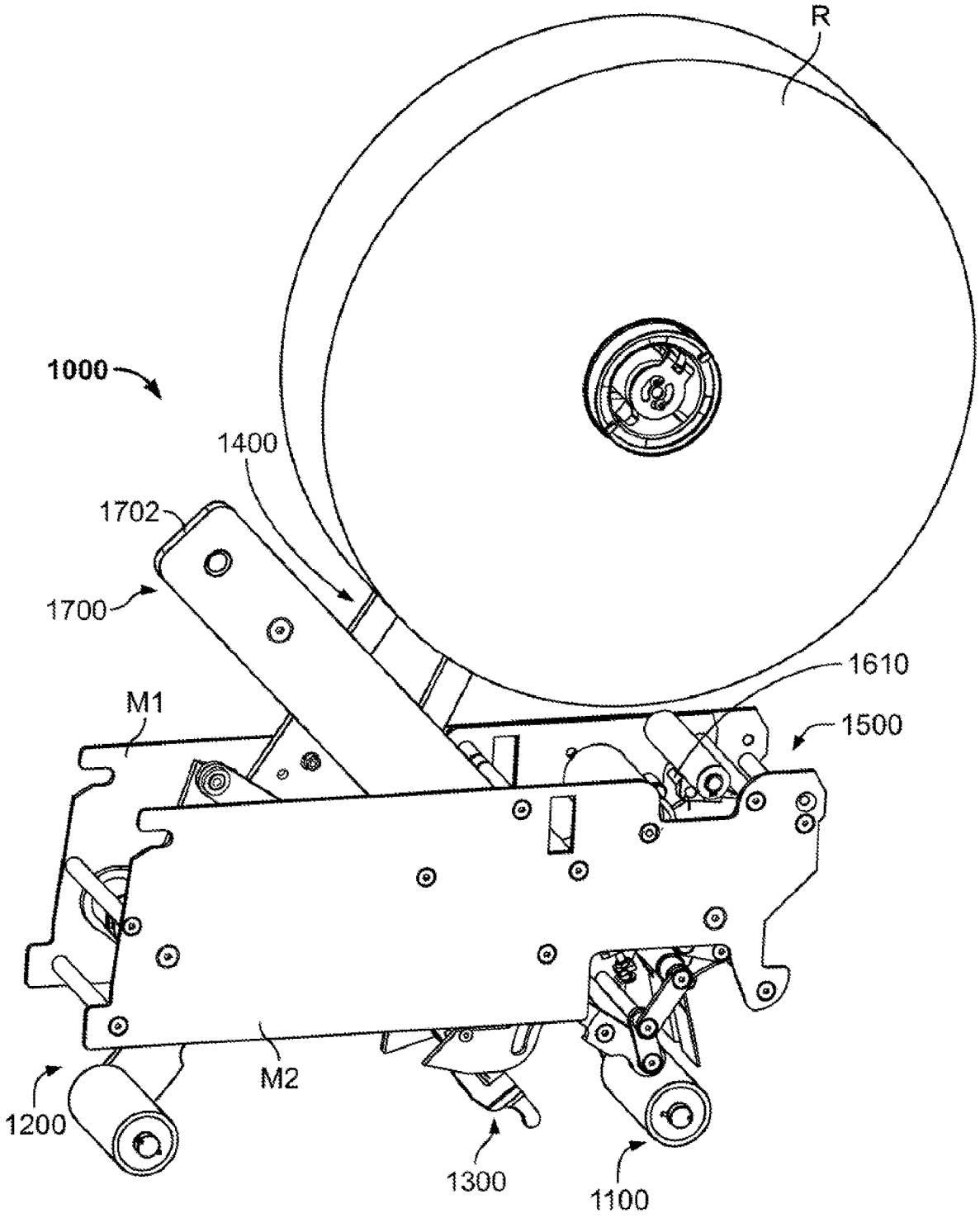
FIGS. 6A-6H are various views of the tape cartridge (and components thereof) of the case sealer of FIG. 1.
Figure 6B:
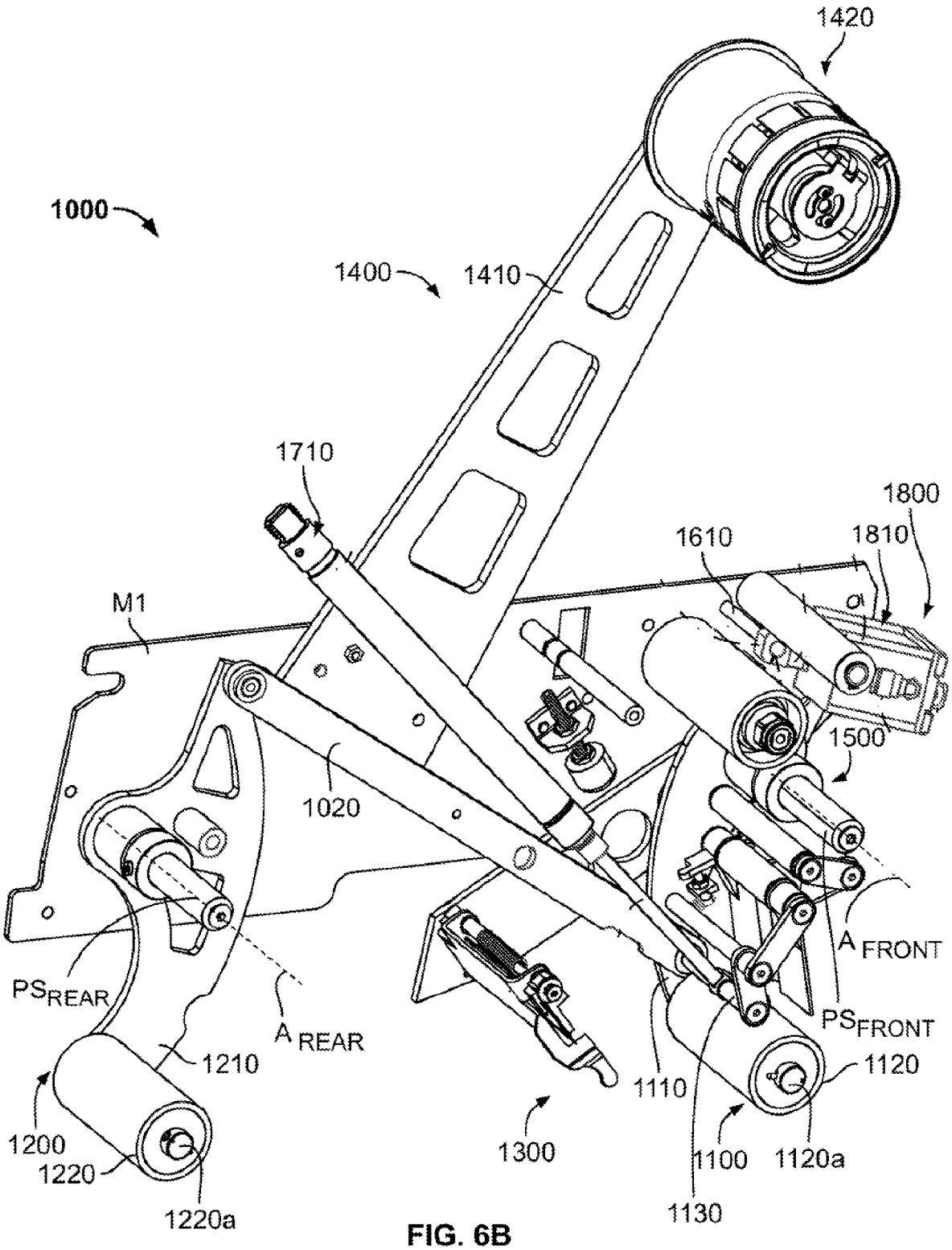
Figure 6C:
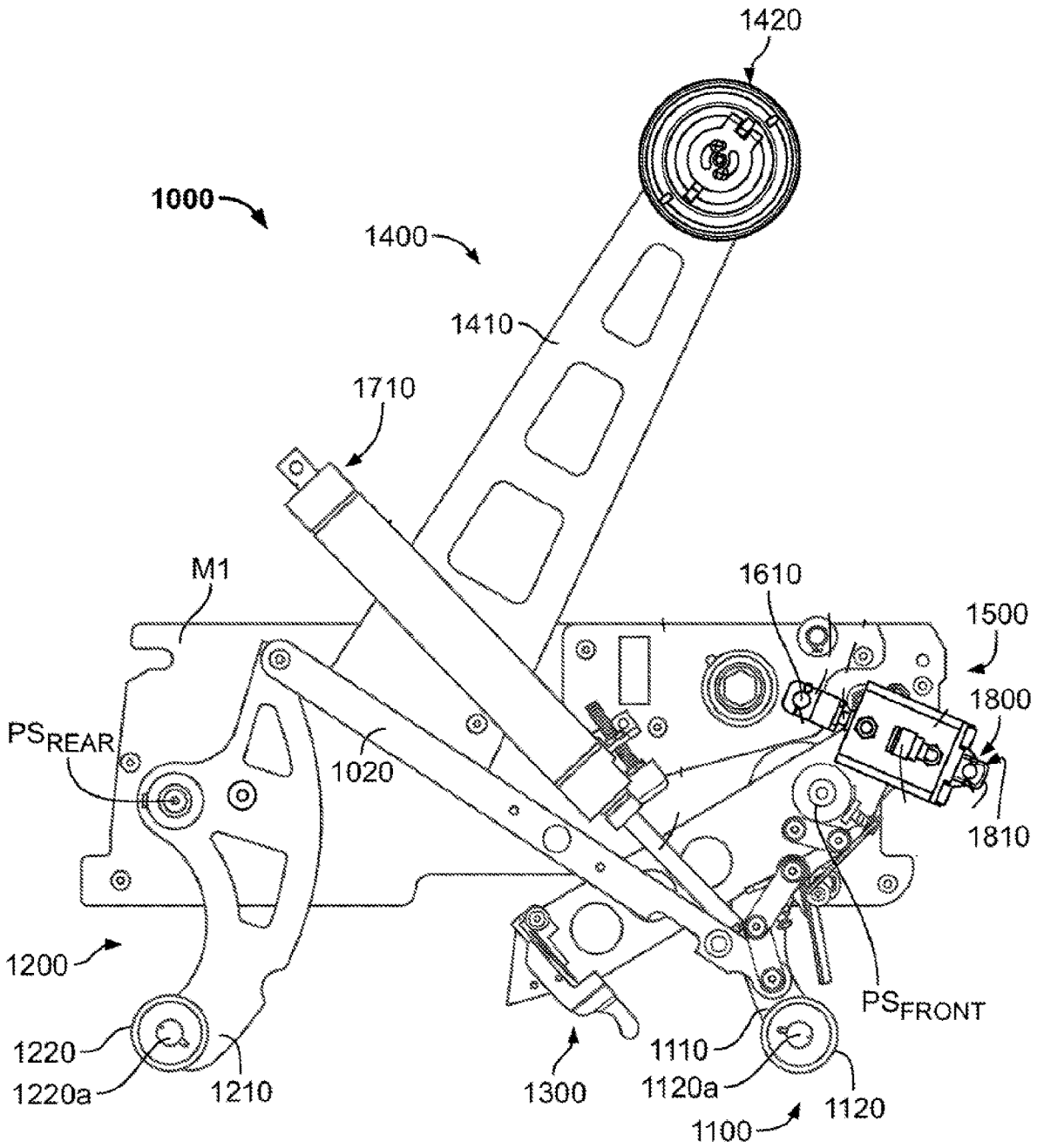

The upper tape cartridge 1000 is removably mounted to the top head assembly 300 and configured to apply tape to a leading surface, a top surface, and a trailing surface of a case. Although not separately described, the lower tape cartridge is removably mounted to the base assembly 100 and configured to apply tape to the leading surface, the bottom surface, and the trailing surface of the case. As best shown in FIGS. 2 and 6A-6H, the tape cartridge 1000 includes a first mounting plate M1 that supports a front roller assembly 1100, a rear roller assembly 1200, a cutter assembly 1300, a tape-mounting assembly 1400, a tension-roller assembly 1500, and a tape-cartridge-actuating assembly 1600. As best shown in FIG. 6A, a second mounting plate M2 is mounted to the first mounting plate M1 via multiple spacer shafts and fasteners (not labeled) to partially enclose certain elements of the front roller assembly 1100, the rear roller assembly 1200, the cutter assembly 1300, the tape-mounting assembly 1400, the tension-roller assembly 1500, and the tape-cartridge-actuating assembly 1600 therebetween.

Figure 6D:
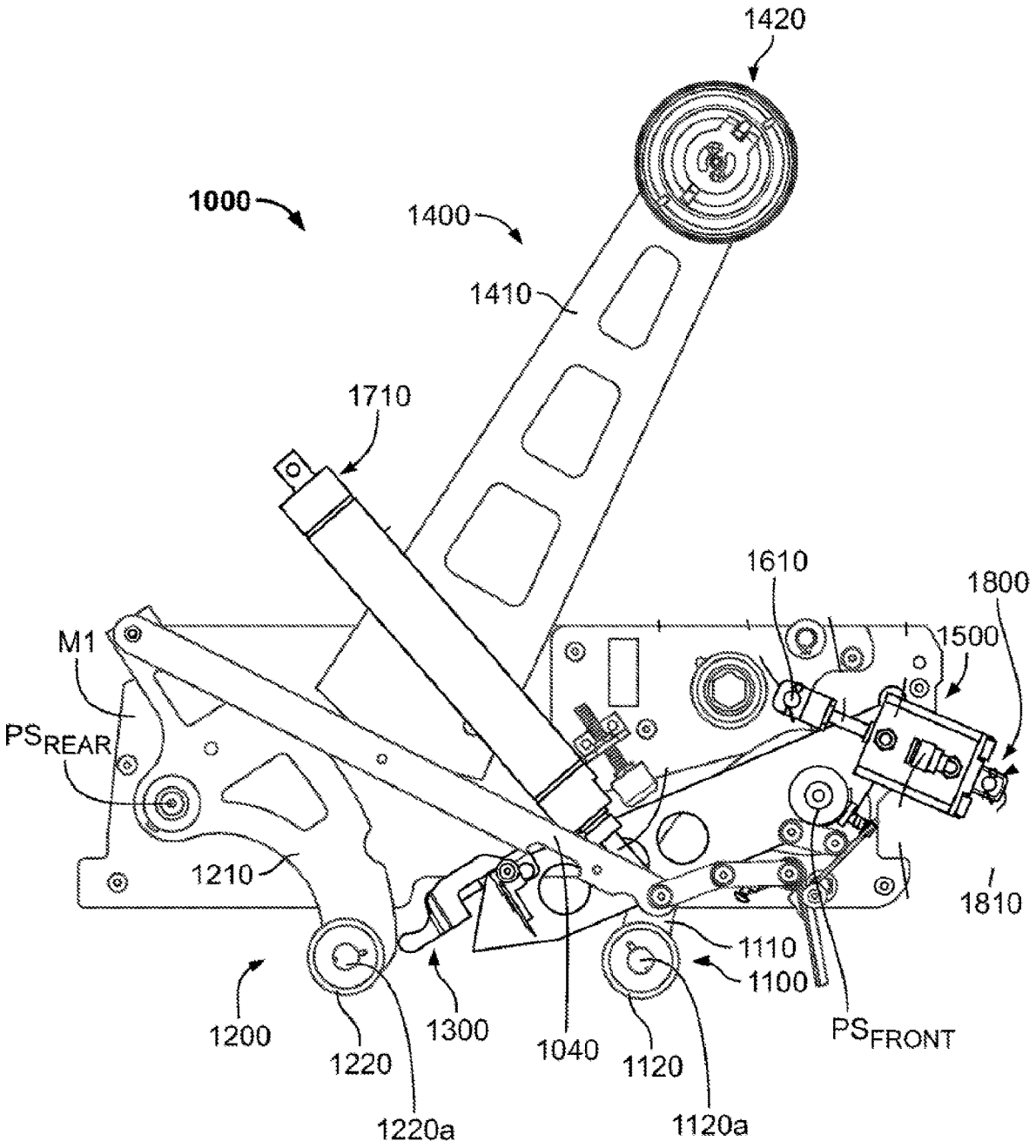

The front roller assembly 1100 includes a front roller arm 1110 and a front roller 1120. The front roller arm 1110 is pivotably mounted to the first mounting plate M1 via a front roller-arm-pivot shaft $PS_{FRONT}$ so the front roller arm 1110 can pivot relative to the mounting plate M1 about an axis $A_{FRONT}$ between a front roller arm extended position (FIGS. 6A-6C) and a front roller arm retracted position (FIG. 6D). The front roller arm 1110 includes a front roller-mounting shaft 1120*a*, and the front roller 1120 is rotatably mounted to the front roller-mounting shaft 1120*a* so the front roller 1120 can rotate relative to the front roller-mounting shaft 1120*a*.

The rear roller assembly 1200 includes a rear roller arm 1210 and a rear roller 1220. The rear roller arm 1210 is pivotably mounted to the first mounting plate M1 via a rear roller-arm-pivot shaft $PS_{REAR}$ so the rear roller arm 1210 can pivot relative to the mounting plate M1 about an axis AREAR between a rear roller arm extended position (FIGS. 6A-6C) and a rear roller arm retracted position (FIG. 6D). The rear roller arm 1210 includes a rear roller-mounting shaft 1220*a*, and the rear roller 1220 is rotatably mounted to the rear roller-mounting shaft 1220*a* so the rear roller 1220 can rotate relative to the rear roller-mounting shaft 1220*a*.

A rigid first linking member 1020 is attached to and extends between the first roller arm 1110 and the second roller arm 1210. The first linking member 1020 links the front and rear roller assemblies 1100 and 1200 so: (1) moving the front roller arm 1110 from the front roller arm extended position to the front roller arm retracted position causes the first linking member 1020 to force the rear roller arm 1210 to move from the rear roller arm extended position to the rear roller arm retracted position (and vice-versa); and (2) moving the rear roller arm 1210 from the rear roller arm extended position to the rear roller arm retracted position causes the first linking member 1020 to force the front roller arm 1110 to move from the front roller arm extended position to the front roller arm retracted position (and vice-versa).

The tape-cartridge-actuating assembly 1600 (FIG. 2) includes a roller-arm-actuating assembly 1700 and a cutter-arm-actuating assembly 1800.

The roller-arm-actuating assembly 1700 is configured to move the linked front and rear roller arms 1110 and 1210 between their respective extended and retracted positions. As best shown in FIG. 6G, in this example embodiment the roller-arm-actuating assembly 1700 includes a support plate 1702 and a roller-arm actuator 1710 pivotably attached to the support plate 1702 via a pin assembly 1703. The roller-arm actuator 1710 may be any suitable actuator, such as a motor or a pneumatic cylinder fed with pressurized gas and controlled by one or more valves.

The roller-arm actuator 1710 is operably connected to the front roller assembly 1100 to control movement of the front roller arm 1110 and the rear roller arm 1210 linked to the front roller arm 1110 between their respective extended and retracted positions. More specifically, the roller-arm actuator 1710 is coupled between the mounting plate M2 and the first roller arm assembly 1100 via attachment of the support plate 1702 to the mounting plate M2 and attachment of the roller-arm actuator 1710 to the shaft 1130 of the front roller assembly 1100.

The controller 90 is operably connected to the roller-arm actuator 1710 and configured to control the roller-arm actuator 1710 and therefore the positions of the front and rear roller arms 1110 and 1210.

Figure 6E:
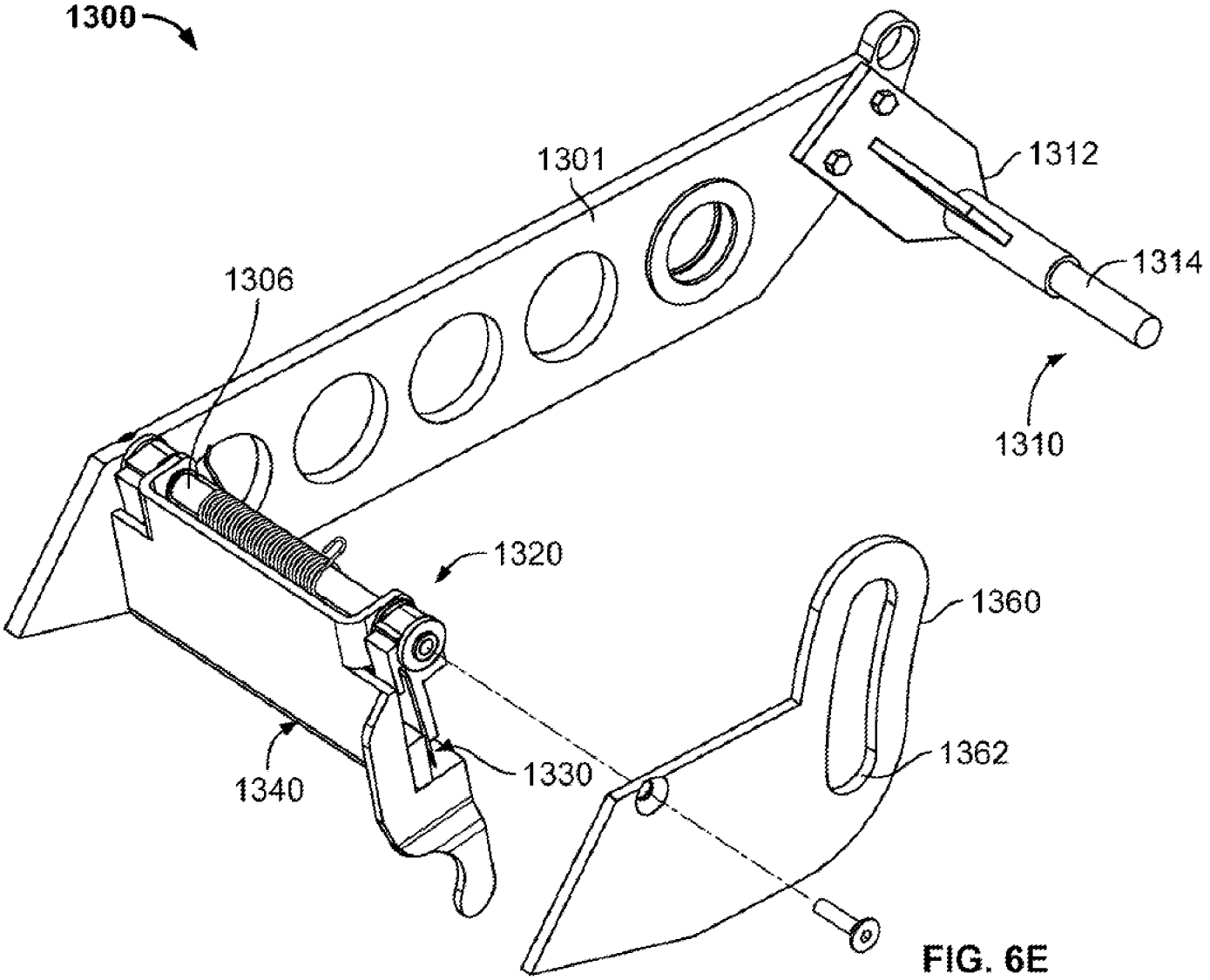
Figure 6F:
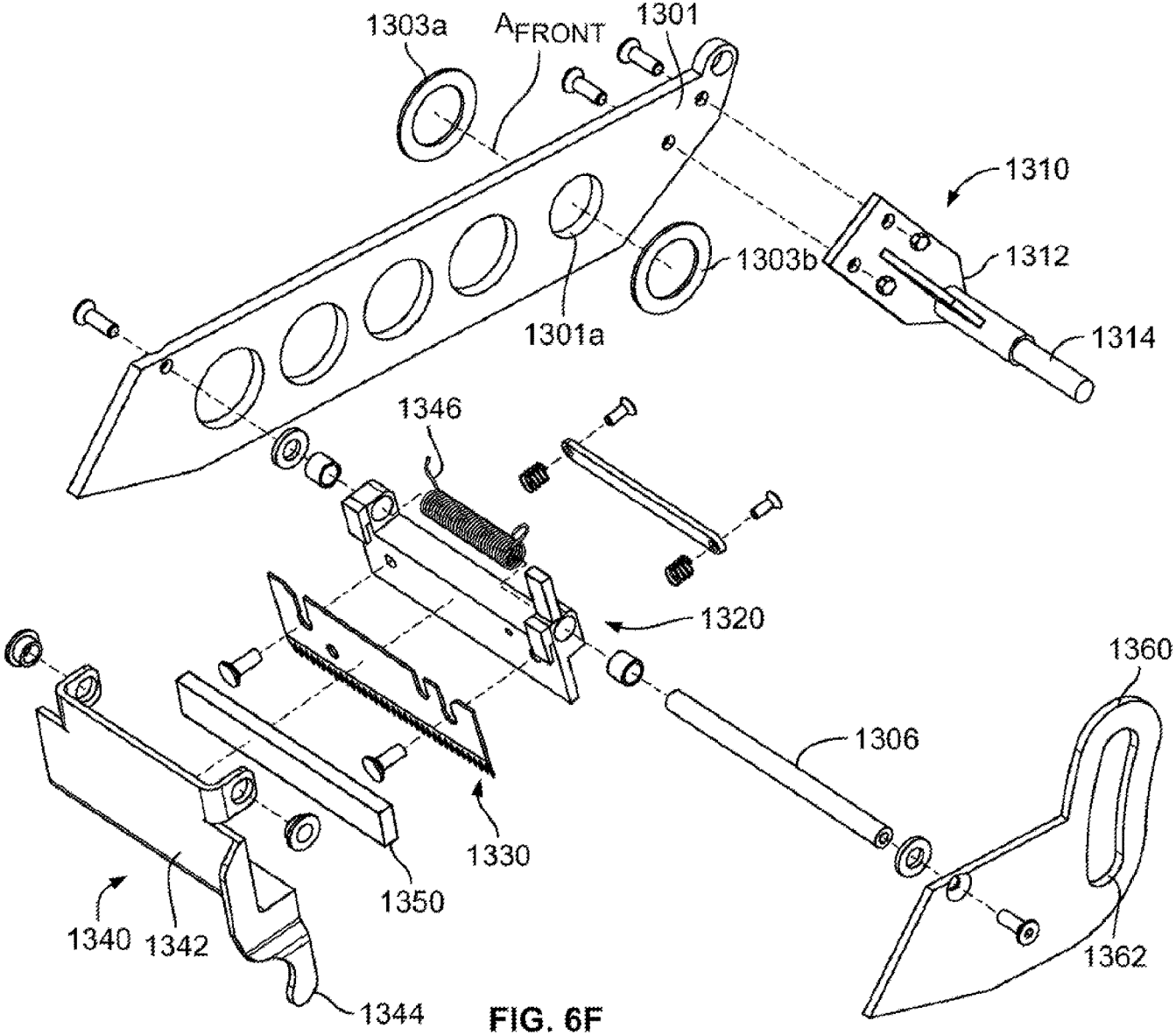

As best shown in FIGS. 6E and 6F, the cutter assembly 1300 includes a cutter arm 1301, a cutting-device cover pivot shaft 1306, a cutter-arm-actuator-coupling element 1310, a cutting-device-mounting assembly 1320, a cutting device 1330 including a toothed blade (not labeled) configured to sever tape, a cutting-device cover 1340, a cutting-device pad 1350, and a rotation-control plate 1360.

The cutter arm 1301 includes a cylindrical surface 1301*a* that defines a cutter arm mounting opening. The cutter arm 1301 is pivotably mounted (via the cutter arm mounting opening) to the first mounting plate M1 via the front roller-arm-pivot shaft $PS_{FRONT}$ and bushings 1303*a* and 1303*b* so the cutter arm 1301 can pivot relative to the mounting plate M1 about the axis $A_{FRONT}$ between a cutter arm extended position (FIGS. 6A-6C) and a cutter arm retracted position (FIG. 6D).

The cutter-arm-actuator-coupling element 1310 includes a support plate 1312 and a coupling shaft 1314 extending transversely from the support plate 1312. The support plate 1312 is fixedly attached to the cutter arm 1301 via fasteners 1316 so the coupling shaft 1314 is generally parallel to and coplanar with the axis $A_{FRONT}$.

The cutting-device-mounting assembly 1320 is fixedly mounted to the support arm 1310 (such as via welding) and is configured to removably receive the cutting device 1330. That is, the cutting-device-mounting assembly 1320 is configured so the cutting device can be removably mounted to the cutting-device-mounting assembly 1320. The cutting-device-mounting assembly 1320 is described in U.S. Pat. No. 8,079,395 (the entire contents of which are incorporated herein by reference), though any other suitable cutting-device-mounting assembly may be used to support the cutting device 1330.

The cutting-device cover 1340 includes a body 1342 and a finger 1344 extending from the body 1342. A pad 1350 is attached to the body 1342. The cutting-device cover 1340 is pivotably mounted to the support arm 1310 via mounting openings (not labeled) and the cutting-device cover pivot shaft 1306. Once attached, the cutting-device cover 1340 is pivotable about the axis $A_{COVER}$ relative to the cutter arm 1301 and the cutting device mount 1320 from front to back and back to front between a closed position and an open position. A cutting-device cover biasing element 1346, which includes a torsion spring in this example embodiment, biases the cutting-device cover 1340 to the closed position. When in the closed position, the cutting-device cover 1340 generally encloses the cutting device 1330 so the pad 1350 contacts the toothed blade of the cutting device 1330. When in the open position, the cutting-device cover 1340 exposes the cutting device 1330 and its toothed blade.

The cutting-device cover pivot shaft 1306 is also attached to the rotation-control plate 1360. The rotation-control plate 1360 includes a slot-defining surface 1362 that defines a slot. The surface 1362 acts as a guide (not shown) for a bushing that is attached to the mounting plate M2. The bushing provides lateral support for the cutter assembly 1300 to generally prevent the cutter assembly from moving toward or away from the mounting plates M1 and M2 and interfering with other components of the tape cartridge 1000 when in use.

Figure 6H:
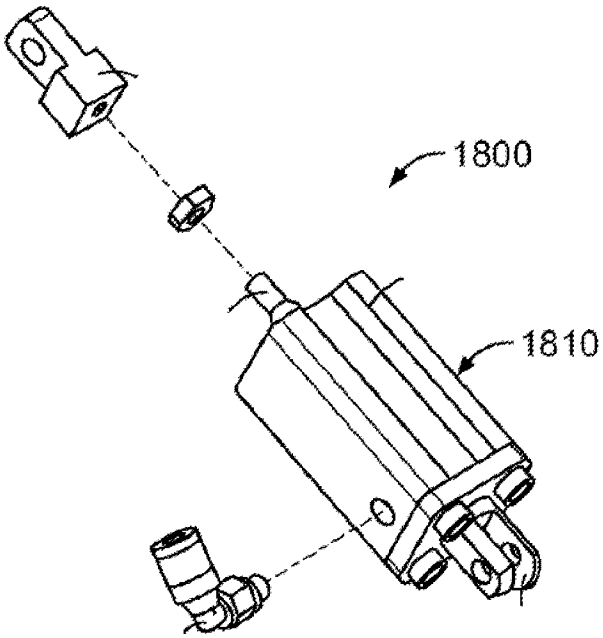
Figure 6G:
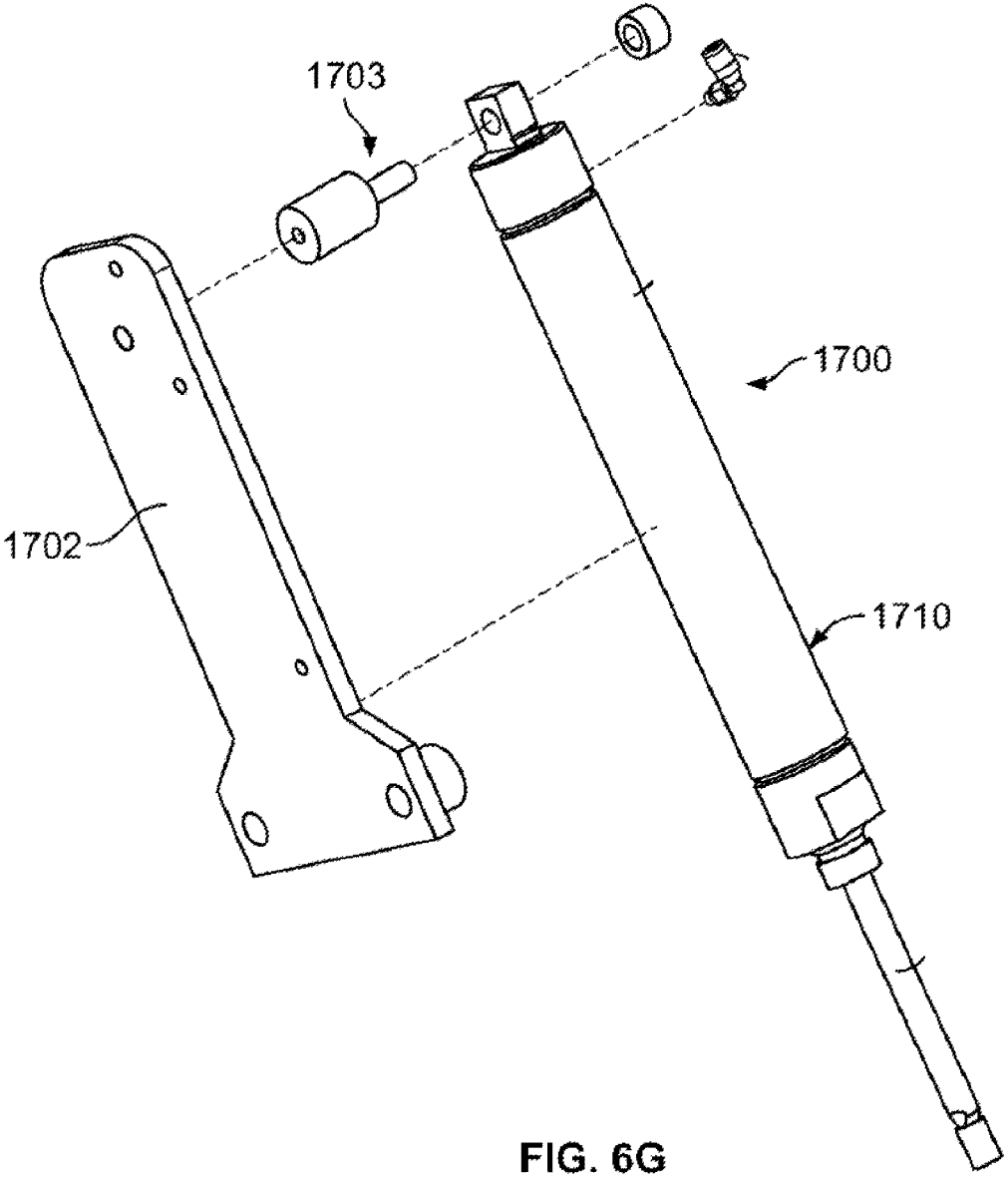

The cutter-arm-actuating assembly 1800 is configured to move the cutter arm 1301 between its retracted position and its extended position. As best shown in FIG. 6H, in this example embodiment the cutter-arm-actuating assembly 1800 includes a cutter-arm actuator 1810. The cutter-arm actuator 1810 may be any suitable actuator, such as a motor or a pneumatic cylinder fed with pressurized gas and controlled by one or more valves.

The cutter-arm actuator 1810 is operably connected to the cutter assembly 1300 to control movement of the cutter arm 1301 from its retracted position to its extended position. More specifically, the cutter-arm actuator 1810 is coupled between the mounting plate M1 and the cutter assembly 1300 via attachment to the shaft 1610 and to the coupling shaft 1314 of the cutter-arm-actuator-coupling element 1310.

The controller 90 is operably connected to the cutter-arm actuator 1810 and configured to control the cutter-arm actuator 1810 and therefore the positions of the cutter arm 1110 and 1301.

The tape-mounting assembly 1400 includes a tape-mounting plate 1410 and a tape-core-mounting assembly 1420 rotatably mounted to the tape-mounting plate 1410. The tape-core-mounting assembly 1420 is further described in U.S. Pat. No. 7,819,357, the entire contents of which are incorporated herein by reference (though other tape core mounting assemblies may be used in other embodiments). A roll R of tape is mountable to the tape-core-mounting assembly 1420.

The tension-roller assembly 1500 includes several rollers (not labeled) rotatably disposed on shafts that are supported by the first mounting plate M1. A free end of the roll R of tape mounted to the tape-core-mounting assembly 1420 is threadable through the rollers until the free end is adjacent the front roller 1120 of the front-roller assembly 1110 with its adhesive side facing outward in preparation for adhesion to a case. The tension-roller assembly 1500 is further described in U.S. Pat. No. 7,937,905, the entire contents of which are incorporated herein by reference (though other tension roller assemblies may be used in other embodiments).

Figure 7:
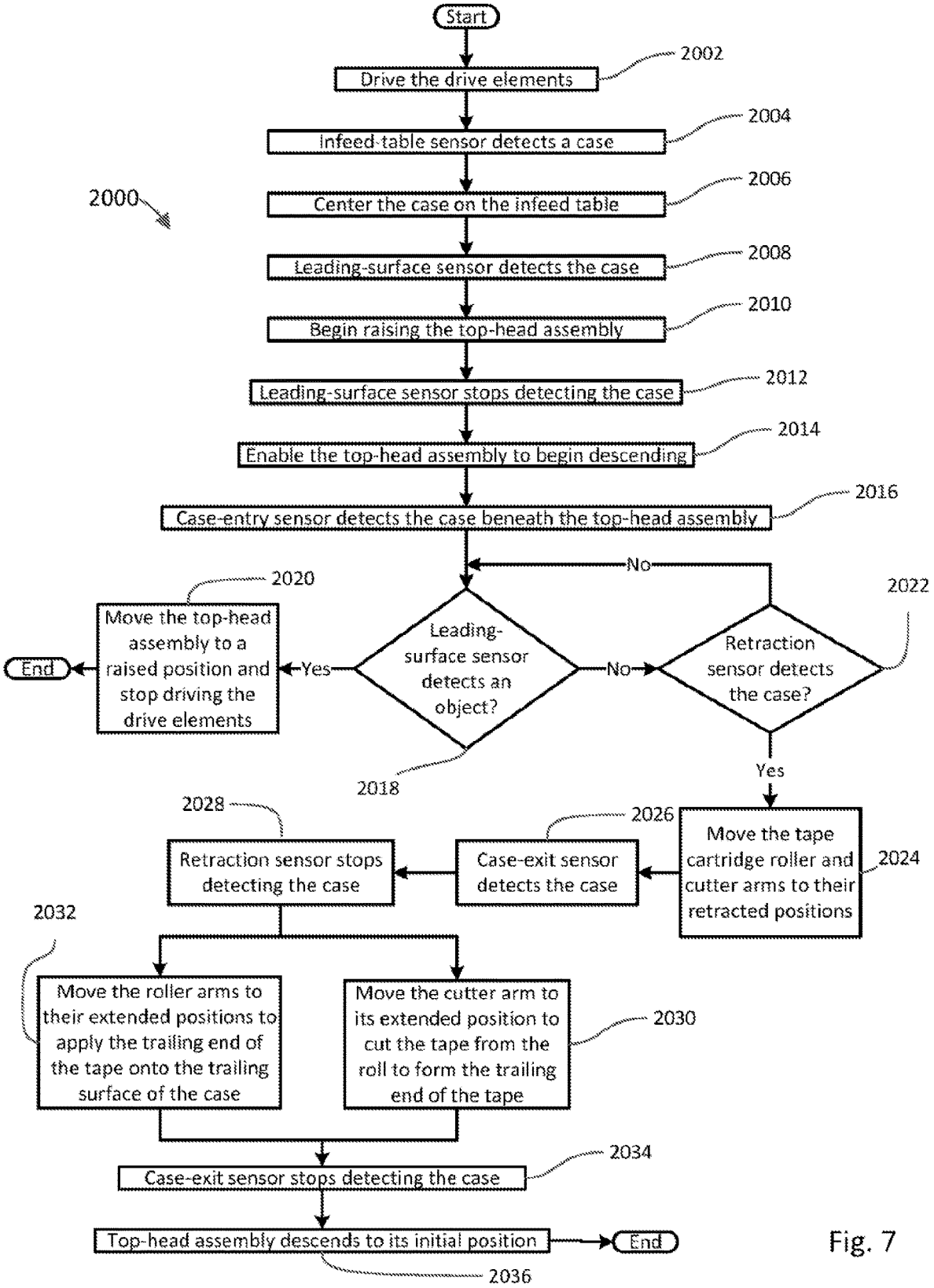
FIG. 7 is a flowchart showing one example case-sealing process.

Operation of the case sealer 10 to seal a case C is now described with reference to the flowchart shown in FIG. 7, which shows a case-sealing process 2000, and FIGS. 8A-8F, which show the case sealer 10 during selected stages of the case-sealing process 2000.

Initially, the top-head assembly 300 is at its initial (lower) position, and the side rails 114*a* and 114*b* are in their rest configuration. The controller 90 controls the bottom-drive-assembly actuator 118 and the top-drive-assembly actuator 322 to drive the bottom drive element of the base assembly 100 and the top-drive element of the top-head assembly, respectively, as block 2002 indicates.

Figure 8A:
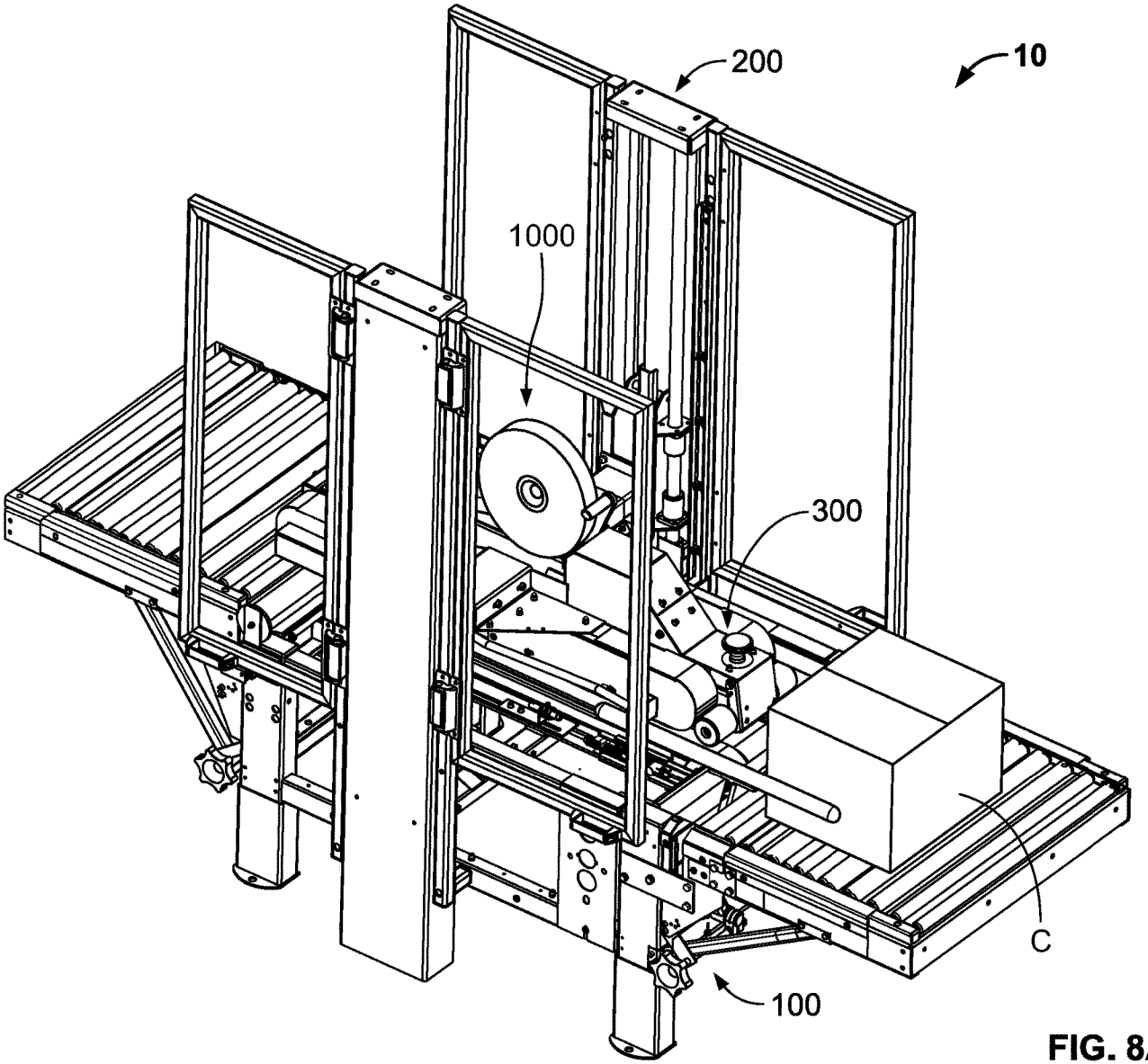
FIGS. 8A-8F are perspective views of the case sealer of FIG. 1 during certain stages of the case-sealing process of FIG. 7.

The operator positions the case C onto the infeed table 112. The infeed-table sensor S1 detects the presence of the case C, as block 2004 indicates, and in response sends a corresponding object-detected signal to the controller 90. Responsive to receiving that object-detected signal, the controller 90 controls the side-rail actuator 117 to move the side rails 114*a* and 114*b* from the rest configuration to the centering configuration so the side rails 114*a* and 114*b* move laterally inward to engage and center the case C on the infeed table 112, as block 2006 indicates and as shown in FIG. 8A.

Figure 8B:
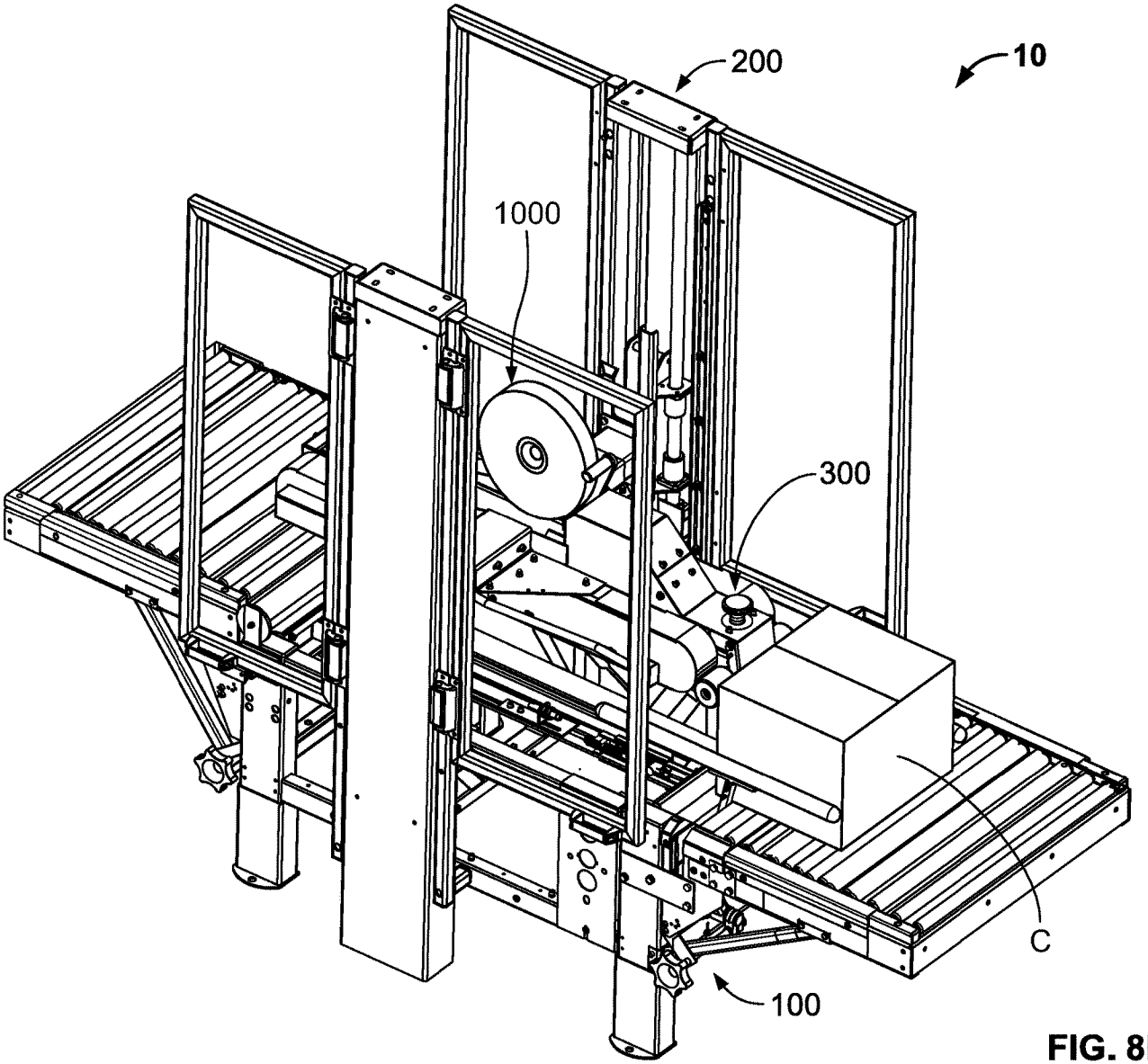

The operator then moves the case C into contact with the leading-surface sensor S2. This causes the leading-surface sensor S2 (via the case C contacting and actuating the paddle switch of the leading-surface sensor S2) to detect the case C, as block 2008 indicates, and in response send a corresponding object-detected signal to the controller 90. Responsive to receiving the object-detected signal, the controller 90 controls the top-head-actuating assembly 205 (and, more particularly, the first and second top-head-actuating-assembly actuators 248 and 288) to begin raising the top-head assembly 300, as block 2010 indicates and as shown in FIG. 8B.

Figure 8C:
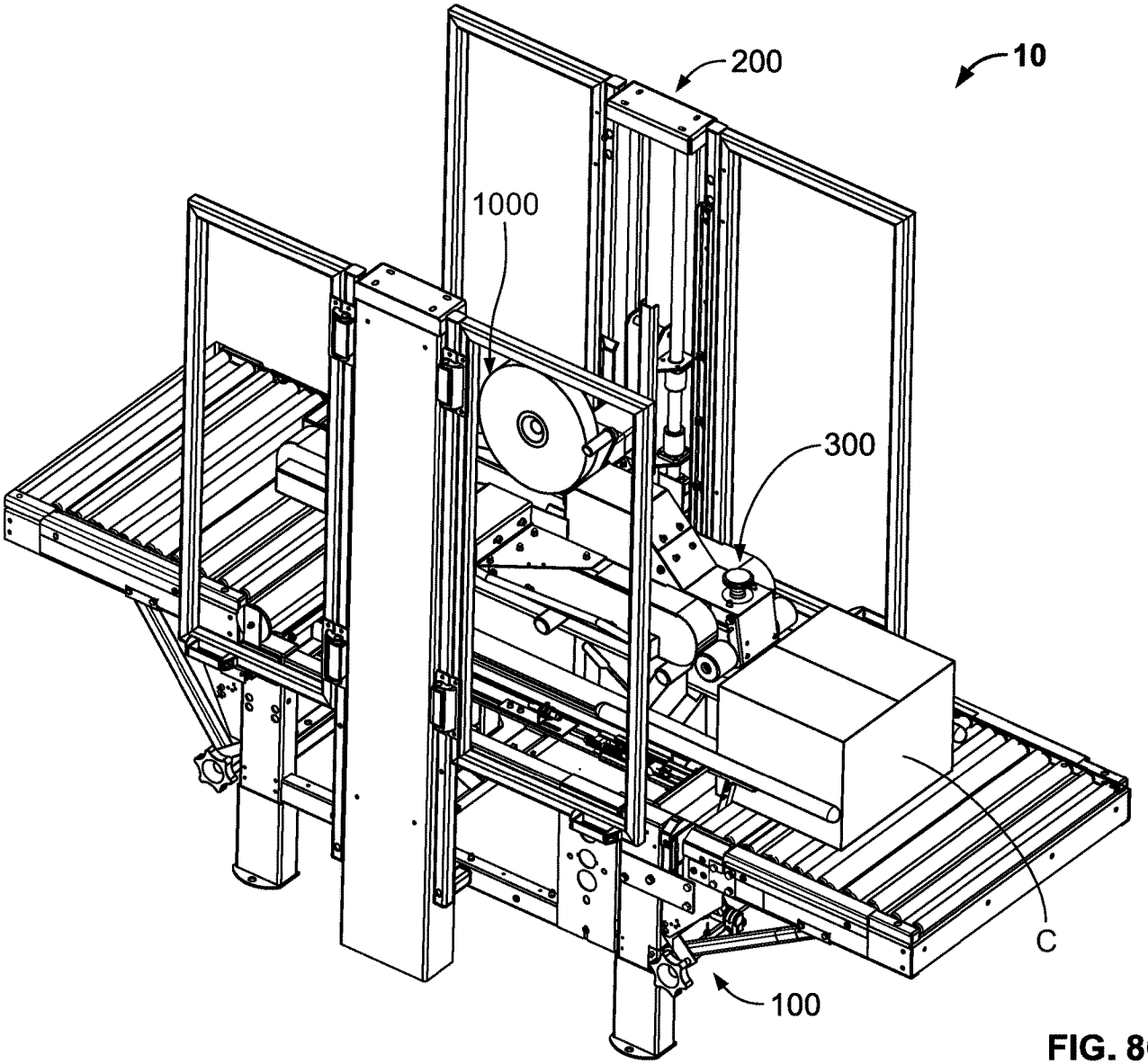
Figure 8D:
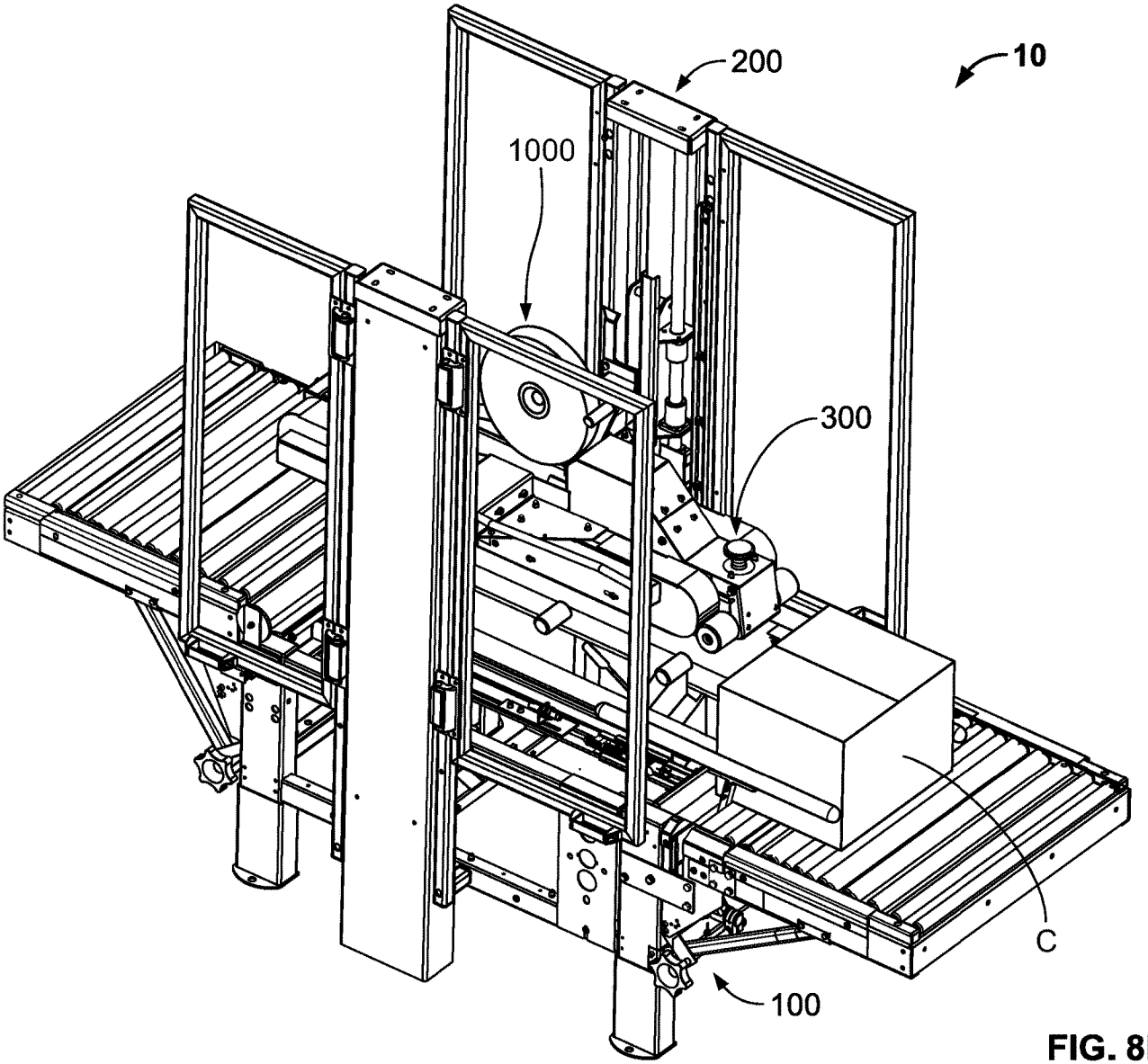

As the top-head assembly 300 moves upward, the leading-surface sensor S2 eventually stops detecting the case C, as block 2012 indicates and as shown in FIGS. 8C and 8D. This indicates that the top-head assembly 300 has ascended above the top surface of the case C. In response to no longer detecting the case C, the leading-surface sensor S2 sends a corresponding object-undetected signal to the controller 90. Responsive to receiving that signal, the controller 90 controls the top-head-actuating assembly 205 (and more particularly the first and second top-head-actuating-assembly actuators 248 and 288) to enable the top-head assembly 300 to stop its ascent and begin descending under its own weight, as block 2014 indicates.

Figure 8E:
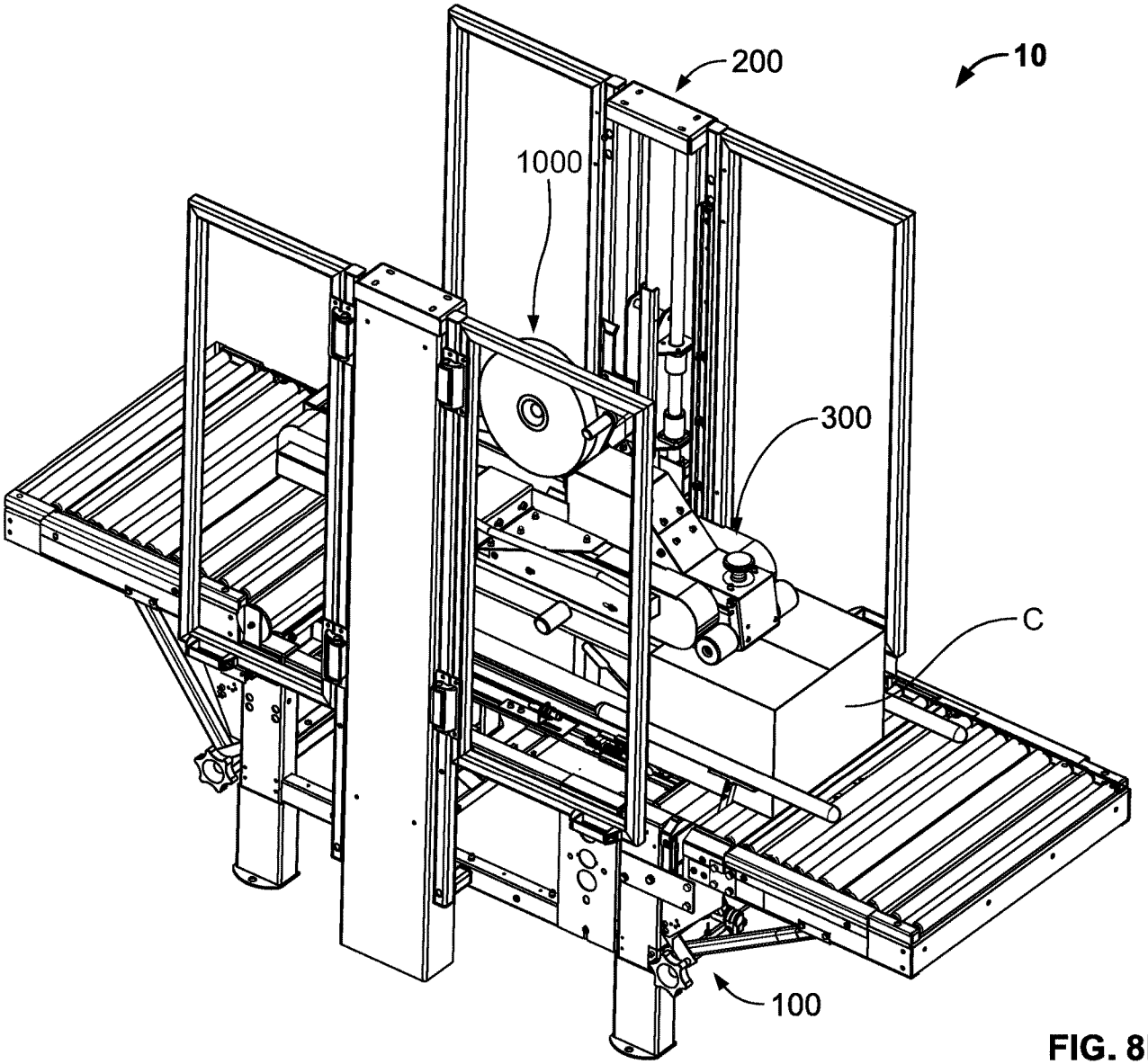

Once the top-head assembly 300 ascends above the top surface of the case C, the operator moves the case C beneath the top-head assembly 300 and into contact with the bottom-drive assembly 115, as shown in FIG. 8E. The case-entry sensor S3 detects the presence of the case C beneath the top-head assembly 300 and in response sends a corresponding object-detected signal to the controller 90, as block 2016 indicates.

Responsive to receiving that object-detected signal, the controller 90 begins monitoring for: (1) another object-detected signal from the leading-surface sensor S2 that, if received, indicates the leading-surface sensor S2 has detected an object between the top-head assembly 300 and the top surface of the case C, as diamond 2018 indicates; and (2) an object-detected signal from the retraction sensor S4 that, if received, indicates the retraction sensor S4 detects the case C, as diamond 2022 indicates. In the meantime, the top- and bottom-drive assemblies 320 and 115 begin moving the case C in the direction D.

Responsive to receiving another object-detected signal from the leading-surface sensor S2 (indicating that the leading-surface sensor S2 has detected an object between the top-head assembly 300 and the top surface of the case C via the object actuating the paddle switch of the leading-surface sensor S2), the controller 90 controls the top-head actuating assembly 205 (and, more particularly, the first and second top-head-actuating-assembly actuators 248 and 288) to move the top-head assembly 300 to a raised position, which in this example embodiment is the position furthest from its initial position and the base assembly 100, and controls the bottom-drive-assembly actuator 118 and the top-drive-assembly actuator 322 to stop driving the bottom drive element of the base assembly 100 and the top-drive element of the top-head assembly 300, as block 2020 indicates. This terminates the case-sealing process 2000 and gives the operator the chance to remove the object from the top surface of the case C before resetting the case sealer 10 and carrying out the case-sealing process 2000 again.

If before receiving another object-detected signal from the leading-surface sensor S2 the controller 90 receives an object-detected signal from the retraction sensor S4 (indicating that the retraction sensor S4 detected the case C), the controller 90 stops monitoring for another object-detected signal from the leading-surface sensor S2 and controls the roller-arm actuator 1710 and the cutter-arm actuator 1810 to move the first and second roller arms 1110 and 1120 and the cutter arm 1301 to their respective retracted positions, as block 2024 indicates. The leading surface of the case C contacts the front roller 1120 of the tape cartridge 1000 as the front roller arm 1110 is moving to its retracted position, which causes the tape positioned on the front roller 1120 to adhere to the leading surface of the case C. When the front and rear roller arms 1110 and 1210 are in their retracted positions, the front and rear rollers 1120 and 1220 are positioned so they apply enough pressure to the tape to adhere the tape to the top surface of the case C. When the cutter arm 1301 is in its retracted position, the cutter arm 1301 does not contact the top surface of the case C (though in certain embodiments it may do so). The controller 90 controls the roller-arm actuator 1710 and the cutter-arm actuator 1810 to retain the front and rear roller arms 1110 and 1210 and the cutter arm 1301 in their respective retracted positions as the top- and bottom-drive assemblies 320 and 115 move the case C past the tape cartridge 1000.

The case C eventually moves off of the infeed table 112, at which point the infeed-table sensor S1 stops detecting the case C and sends a corresponding object-undetected signal to the controller 90. Responsive to receiving that object-undetected signal, the controller 90 controls the side-rail actuator 117 to move the side rails 114*a* and 114*b* from the centering configuration to the rest configuration to make space on the infeed table 112 for the next case to-be-sealed.

At some point, the case-exit sensor S5 detects the presence of the case C, as block 2026 indicates (though this may occur after the retraction sensor S4 stops detecting the case C depending on the length of the case), and sends a corresponding object-detected signal to the controller 90.

Once the retraction sensor S4 stops detecting the case (indicating that the case has moved past the retraction sensor S4), the retraction sensor S4 sends a corresponding object-undetected signal to the controller 90, as block 2028 indicates. In response, the controller 90 controls the roller-arm actuator 1710 to return the first and second roller arms 1110 and 1120 to their respective extended positions to apply tape to the trailing surface of the case and controls the cutter-arm actuator 1810 to return the cutter arm 1301 to its extended position to cut the tape from the roll, as blocks 2032 and 2034 indicate. As this occurs, the finger 1344 of the cutting-device cover 1340 contacts the top surface of the case so the cutting-device cover 1340 pivots to the open position and exposes the cutting device 1330. Continued movement of the cutter arm 1301 brings the toothed blade of the cutting device 1330 into contact with the tape and severs the tape from the roll R. As the front and rear roller arms 1110 and 1210 move back to their extended positions, the rear roller arm 1210 moves so the rear roller 1220 contacts the severed end of the tape and applies the tape to the trailing surface of the case C to complete the taping process.

Figure 8F:
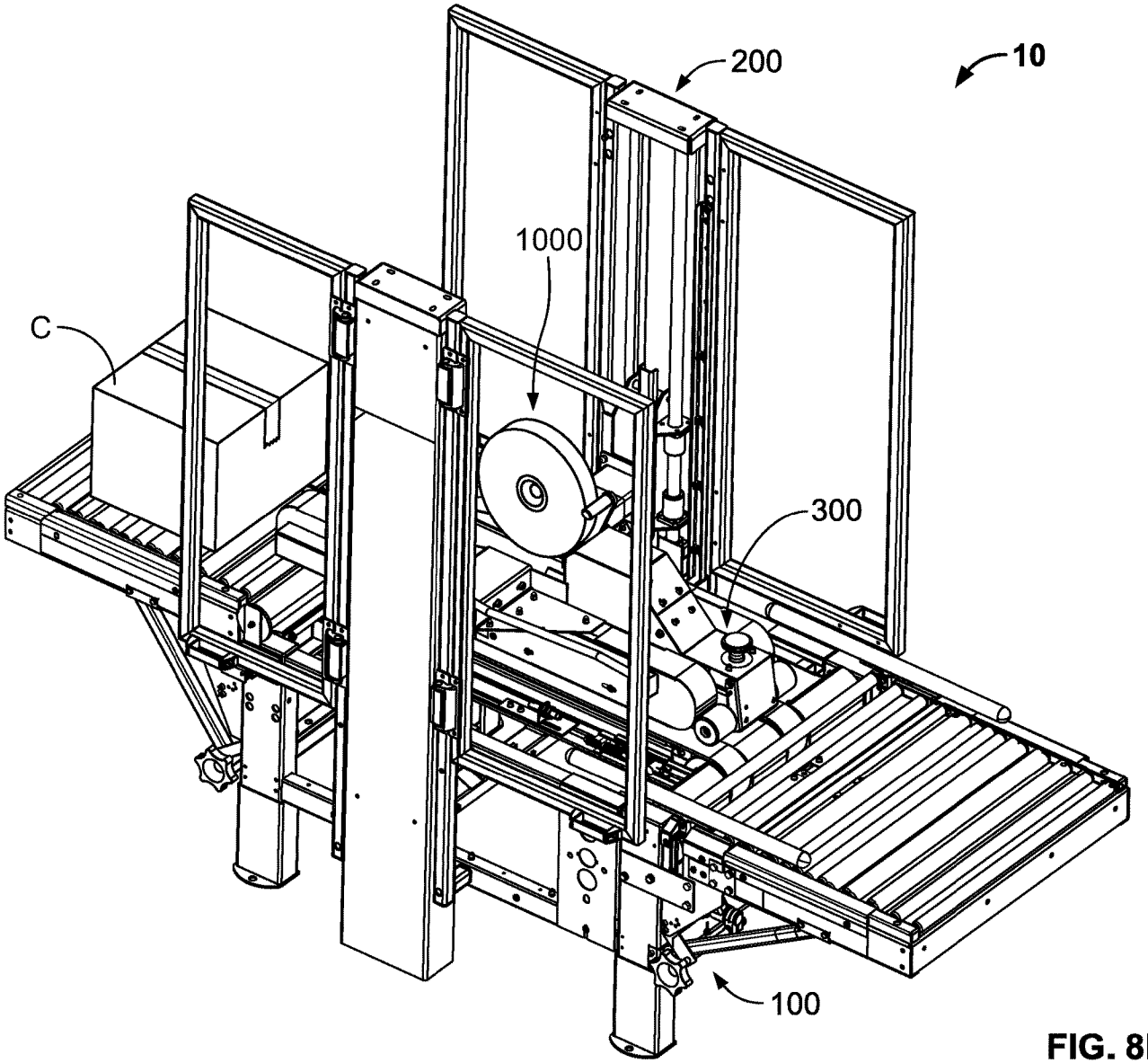

The top- and bottom-drive assemblies 320 and 115 continue to move the case C until it exits from beneath the top-head assembly 300 onto the outfeed table 113, at which point the case-exit sensor S5 stops detecting the case, as block 2034 indicates, and sends a corresponding object-undetected signal to the controller 90. The top-head assembly 300 then descends back to its initial position under its own weight, as shown in FIG. 8F.

In some embodiments, the tape cartridge includes biasing elements that bias the roller arms and the cutter arm to their respective extended positions. The biasing elements eliminate the need for direct actuation of the roller arms and the cutter arm from their respective retracted positions to their respective extended positions.

In certain embodiments, the controller is separate from and in addition to the sensors. In other embodiments, the sensors act as their own controllers. For instance, in one embodiment, the retraction sensor is configured to directly control the cutter and roller arm actuators responsive to detecting the presence of and the absence of the case, the infeed-table sensor is configured to directly control the side rail actuator responsive to detecting the presence of and the absence of the case, and the leading-surface and top-surface sensors are configured to directly control the top head actuator responsive to detecting the presence of and the absence of the case (or contact with the case).

The example embodiment of the case sealer described above and shown in the Figures is a semiautomatic case sealer in which an operator feeds closed cases beneath the top-head assembly. This is merely one example embodiment, and the case sealer may be any other suitable type of case sealer, such as an automatic case sealer in which a machine automatically feeds closed cases beneath the top-head assembly.

The invention claimed is:

1. A case sealer comprising:

a base assembly;

a top-head assembly supported by the base assembly;

an actuator operably connected to the top-head assembly to move the top-head assembly relative to the base assembly;

a first sensor configured to transmit an object-detected signal responsive to detecting an object and an object-undetected signal responsive to no longer detecting the object;

a second sensor configured to transmit an object-detected signal responsive to detecting the object beneath the top-head assembly;

a tape cartridge downstream of the second sensor and configured to apply tape from a tape supply to the object; and a controller communicatively connected to the first and second sensors and operably connected to the actuator, the controller configured to:

receive a first object-detected signal from the first sensor;

responsive to receiving the first object-detected signal from the first sensor, control the actuator to begin raising the top-head assembly;

after receiving the first object-detected signal from the first sensor, receive a first object-detected signal from the second sensor; and after receiving the first object-detected signal from the second sensor and responsive to receiving a second object-detected signal from the first sensor while the object is beneath the top-head assembly and before the object has reached the tape cartridge, control the actuator to begin raising the top-head assembly.

2. The case sealer of claim 1, further comprising a third sensor communicatively connected to the controller and configured to transmit an object-detected signal responsive to detecting the object.

3. The case sealer of claim 2, wherein the controller is further configured to, after receiving the first object-detected signal from the second sensor and responsive to receiving a first object-detected signal from the third sensor before receiving the second object-detected signal from the first sensor, not control the actuator to begin raising the top-head assembly responsive to receiving the second object-detected signal from the first sensor.

4. The case sealer of claim 3, wherein the tape cartridge comprises a cutter arm and a cutter-arm actuator operably coupled to the cutter arm to move the cutter arm from an extended position to a retracted position, wherein the controller is further configured to, responsive to receiving the first object-detected signal from the third sensor, control the cutter-arm actuator to move the cutter arm from the extended position to the retracted position.

5. The case sealer of claim 4, wherein the tape cartridge further comprises a roller arm comprising a roller and a roller-arm actuator operably coupled to the roller arm to move the roller arm from an extended position to a retracted position, wherein the controller is further configured to, responsive to receiving the first object-detected signal from the third sensor, control the roller-arm actuator to move the roller arm from the extended position to the retracted position.

6. The case sealer of claim 2, wherein the second sensor is positioned downstream of the first sensor and the third sensor is positioned downstream of the second sensor.

7. The case sealer of claim 1, further comprising a mast assembly supported by the base assembly, the mast assembly comprising the actuator and supporting the top-head assembly, wherein the second sensor is supported by the base assembly and the first sensor is supported by the top-head assembly.

8. The case sealer of claim 1, further comprising a drive assembly comprising a drive element and a drive-assembly actuator operably connected to the drive element to drive the drive element, wherein the controller is operably connected to the drive-assembly actuator and further configured to, responsive to receiving the second object-detected signal from the first sensor, control the drive-assembly actuator to stop driving the drive element.

9. The case sealer of claim 1, wherein the top-head assembly is movable relative to the base assembly between a lowermost position and an uppermost position, wherein controller is further configured to, responsive to receiving the second object-detected signal from the first sensor, control the actuator to raise the top-head assembly to its uppermost position.

10. The case sealer of claim 1, wherein the controller is further configured to:

receive a first object-undetected signal from the first sensor;

responsive to receiving the first object-undetected signal from the first sensor, control the actuator to enable the top-head assembly to begin descending; and after receiving the first object-detected signal and the first object-undetected signal from the first sensor, receive the first object-detected signal from the second sensor.

11. The case sealer of claim 10, further comprising a third sensor communicatively connected to the controller and configured to transmit an object-detected signal responsive to detecting the object, wherein the controller is further configured to, after receiving the first object-detected signal from the second sensor, responsive to receiving a first object-detected signal from the third sensor before receiving the second object-detected signal from the first sensor, not control the actuator to begin raising the top-head assembly responsive to receiving the second object-detected signal from the first sensor.

12. The case sealer of claim 11, wherein the tape cartridge comprises a cutter arm and a cutter-arm actuator operably coupled to the cutter arm to move the cutter arm from an extended position to a retracted position, wherein the controller is further configured to, responsive to receiving the first object-detected signal from the third sensor, control the cutter-arm actuator to move the cutter arm from the extended position to the retracted position.

13. The case sealer of claim 12, wherein the second sensor is positioned downstream of the first sensor and the third sensor is positioned downstream of the second sensor.

* * * * *